US011680768B2

(12) United States Patent
Peacemaker et al.

(10) Patent No.: US 11,680,768 B2
(45) **Date of Patent: *Jun. 20, 2023**

(54) POWER ASSISTED BOW

(71) Applicant: SOS Solutions, Inc., Tonasket, WA (US)

(72) Inventors: Samuel R. Peacemaker, Gilbert, AZ (US); Benjamin Peacemaker, Chandler, AZ (US); Zachary Peacemaker, Parker, CO (US)

(73) Assignee: SOS Solutions, Inc., Tonasket, WA (US)

( * ) Notice: Subject to any disclaimer, the term of this patent is extended or adjusted under 35 U.S.C. 154(b) by 10 days.

This patent is subject to a terminal disclaimer.

(21) Appl. No.: 17/207,092

(22) Filed: Mar. 19, 2021

(65) Prior Publication Data

US 2021/0348873 A1 Nov. 11, 2021

Related U.S. Application Data

(63) Continuation of application No. 16/436,449, filed on Jun. 10, 2019, now Pat. No. 11,029,120, which is a (Continued)

(51) Int. Cl.
*F41B 5/14* (2006.01)
*F41B 5/10* (2006.01)

(52) U.S. Cl.
CPC ..... *F41B 5/1403* (2013.01); *F41B 5/1469* (2013.01); *F41B 5/10* (2013.01)

(58) Field of Classification Search
CPC ..... F41B 5/1403; F41B 5/10; F41B 5/105
See application file for complete search history.

(56) References Cited

U.S. PATENT DOCUMENTS 3,552,373 A 1/1971 Van Hecke
3,981,290 A * 9/1976 Islas ..... F41B 5/0005 124/88

(Continued)

FOREIGN PATENT DOCUMENTS

WO 2012149190 11/2012

OTHER PUBLICATIONS

USPTO; Non-Final Office Action dated Feb. 25, 2015 in U.S. Appl. No. 14/214,167.

(Continued)

*Primary Examiner* — Eugene L Kim
*Assistant Examiner* — Christopher Glenn
(74) *Attorney, Agent, or Firm* — Snell & Wilmer L.L.P.

(57) ABSTRACT

A compound bow may feature the ability to pre-store energy before the drawing back of the draw string. Various embodiments contemplate that this may allow an archer to draw back the draw string or cable, and upon reaching the let off region of the compound bow's draw profile, cause the pre-stored energy to be transferred to the energy being stored by the bow. Various embodiments contemplate that this addition of pre-stored energy may give the archer more energy, held in the draw string or cable, to transfer to an arrow upon release, propelling it at greater speeds than would have been achieved with a compound bow of equal draw weight that does not feature an energy storage mechanism. Various embodiments contemplate that a system may provide for a return position of the draw.

8 Claims, 34 Drawing Sheets

Related U.S. Application Data continuation of application No. 14/214,167, filed on Mar. 14, 2014, now Pat. No. 10,359,253.

(60) Provisional application No. 61/802,167, filed on Mar. 15, 2013.

(56) References Cited

U.S. PATENT DOCUMENTS 4,246,883 A * 1/1981 Ash ..... F41B 5/1469 124/86
4,261,321 A * 4/1981 Nishioka ..... F41B 5/10 124/67
4,294,221 A * 10/1981 Bryant ..... F41B 5/10 124/900
4,471,747 A * 9/1984 Nishioka ..... F41B 5/105 124/88
4,877,009 A 10/1989 Becker
4,886,039 A * 12/1989 Wagner ..... F41B 5/10 124/900
5,092,309 A * 3/1992 Beaton ..... F41B 5/10 124/900
5,115,795 A 5/1992 Farris
5,203,314 A 4/1993 Green
5,950,609 A * 9/1999 Thielen ..... F41B 5/10 124/25.6
6,213,113 B1 4/2001 Groover et al.
6,371,098 B1 4/2002 Winther
6,499,478 B1 12/2002 Perez
6,681,754 B1 * 1/2004 Angeloni ..... F41B 5/143 124/44.5
8,893,694 B1 * 11/2014 DeBole ..... F41B 5/10 124/25.6
2003/0089359 A1 5/2003 Bednar
2005/0022799 A1 2/2005 Bednar
2010/0108047 A1 5/2010 Jones
2010/0170486 A1 7/2010 Kronengold et al.
2010/0170487 A1 7/2010 Kronengold et al.
2011/0220085 A1 * 9/2011 Christensen ..... F41B 5/0005 124/25.6
2011/0232619 A1 9/2011 Bednar et al.
2012/0204849 A1 8/2012 Bednar et al.
2012/0222663 A1 9/2012 Nebergall
2013/0061839 A1 * 3/2013 Asherman ..... F41B 5/10 124/31
2014/0069405 A1 * 3/2014 Peacemaker ..... F41B 5/105 124/25.6
2014/0190460 A1 * 7/2014 Langley ..... F41B 5/105 124/25.6
2014/0261355 A1 9/2014 Peacemaker et al.
2014/0261356 A1 9/2014 Peacemaker et al.

OTHER PUBLICATIONS

USPTO; Final Office Action dated Dec. 3, 2015 in U.S. Appl. No. 14/214,167.
USPTO; Non-Final Office Action dated Dec. 22, 2016 in U.S. Appl. No. 14/214,167.
USPTO; Final Office Action dated Sep. 8, 2017 in U.S. Appl. No. 14/214,167.
USPTO; Non-Final Office Action dated Mar. 21, 2018 in U.S. Appl. No. 14/214,167.
USPTO; Final Office Action dated Oct. 18, 2018 in U.S. Appl. No. 14/214,167.
USPTO; Notice of Allowance dated Mar. 25, 2019 in U.S. Appl. No. 14/214,167.
European Patent Office, Communication under Rule 71 (3) EPC dated Feb. 19, 2019 in EP Application No. 14 763 494.3-1011.
PCT Search Report and Written Opinion dated Aug. 28, 2014 for PCT Application No. PCT/US 14129523, 10 Pages.
PCT Search Report and Written Opinion dated Oct. 7, 2014 for PCT Application No. PCT/US 14129558, 10 Pages.
USPTO; Non-Final Office Action dated Feb. 25, 2015 in U.S. Appl. No. 14/214,199.
USPTO; Final Office Action dated Dec. 3, 2015 in U.S. Appl. No. 14/214,199.
USPTO; Non-Final Office Action dated Dec. 26, 2016 in U.S. Appl. No. 14/214,199.
USPTO; Final Office Action dated Sep. 7, 2017 in U.S. Appl. No. 14/214,199.
USPTO; Restriction/Election Requirement dated Jun. 8, 2020 in U.S. Appl. No. 16/436,449.
USPTO; Non-Final Office Action dated Jul. 24, 2020 in U.S. Appl. No. 16/436,449.
USPTO; Final Office Action dated Jan. 21, 2021 in U.S. Appl. No. 16/436,449.

* cited by examiner

POWER ASSISTED BOW

CROSS REFERENCE TO RELATED APPLICATIONS

This application is a continuation application of and claims priority to U.S. patent application Ser. No. 16/436,449, entitled "POWER ASSISTED BOW," which was filed on Jun. 10, 2019. The '449 Application is a continuation application of and claims priority to U.S. patent application Ser. No. 14/214,167, entitled "POWER ASSISTED BOW," which was filed on Mar. 14, 2014 (aka U.S. Pat. No. 10,359,253 issued on Jul. 23, 2019). The above application claims priority to U.S. Provisional Application Ser. No. 61/802,167, entitled "POWER ASSISTED BOW," which was filed on Mar. 15, 2013. Each of the above are incorporated herein by reference in their entirety.

BACKGROUND

Various types of archery bows have been developed including traditional bows, such as, longbows and recurve bows, and more recently compound bows. As a general matter, archery bows include a pair of opposed limbs extending outwardly from the opposite ends of a handle of the bow. As an archer draws the bow by pulling on a string or cable, the limbs flex and store energy. This energy is then transferred to the arrow as the archer releases the string or cable.

The limbs of a compound bow are generally much stiffer than those of a recurve bow or a longbow. This limb stiffness may make the compound bow more energy efficient than other archery bows when used in conjunction with the pulley/cams as employed in modern compound bow construction. As is generally known, the compound bow has a string or cable which is applied to a variety of differently designed pulleys or cam shaped members. Further, the compound bow has one or more pulleys or cams which have other cables attached to the opposite limbs. When the string is drawn back, the string causes the pulleys or cams to turn. As force is applied, and as this draw continues, an archer has a reduced mechanical advantage, but during the draw as the pulley or cams rotate, and the archer gains mechanical advantage over the bending limbs, more energy is stored in the limbs in comparison to other archery bows. Generally speaking, the use of this well known leveraging system gives the compound bow a characteristic draw-force curve, which rises to a peak weight, and then, lets off, or reduces dramatically to a lower holding weight. This feature of the compound bow permits the archer to draw the arrow and then maintain aim on their target, prior to the release of the arrow, for a longer period of time thereby resulting in a better aimed shot. Generally speaking, one of the principal objectives of most archery bow design is to increase the speed at which an arrow is projected or propelled by a bow. Arrows which fly faster can maintain a flatter trajectory over a greater distance than slower traveling arrows. This enables faster flying arrows to be fired more accurately than slower traveling arrows.

While the various designs of compound bows have operated with various degrees of success, assorted shortcomings have detracted from their usefulness. One of the chief shortcomings to the compound bows that have been developed so far is that the strength required by the archer to draw the string or cable to an arrow release position steadily increases as the bow strength increases. While the assorted cams and other leverage achieved by the previous compound bow designs have reduced the amount of strength that the archer needs to have to hold the string at a full, arrow release position, the archer must still have a certain amount of strength, which will permit the archer to first draw the arrow, and then return the arrow from an arrow release position, to an at rest position in the event that the archer does not release the arrow at a target. Those skilled in the art recognize that bringing a compound bow back to an at rest position, from a previous, fully drawn position often requires a bit of strength, and talent, in order to prevent uncontrolled movement of the bow as the arrow is being returned. This is particularly important to hunters, especially when an archer is shooting from a camouflaged position, or from a tree stand, and the like, and where an excessive amount of movement of the bow could have the effect of scaring-off a potential animal target.

An archery bow, an archery bow accessory, and/or conversion kit addresses these and other shortcomings attendant with existing archery bows, and other devices employed with archery bows, heretofore, is the subject matter of the present disclosure.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A compound bow may feature an ability to pre-store energy before the drawing back of the draw string or cable. Various embodiments contemplate that this may allow an archer to draw back the draw string or cable, and upon reaching the let off region of the compound bow's draw profile, cause the pre-stored energy to be transferred and/or added to the energy being stored by drawing back the draw string or cable. Various embodiments contemplate that this addition of pre-stored energy may give the archer more energy, held in the draw string or cable, to release and/or transfer to an arrow, propelling it at a greater speed than would have been achieved with a compound bow of equal draw weight that does not feature an energy storage mechanism.

Various embodiments contemplate that a system may provide for a return position of the draw. For example, this may remove the pre-stored energy from the draw string or cable as the draw string or cable is returned to an undrawn position.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1B:
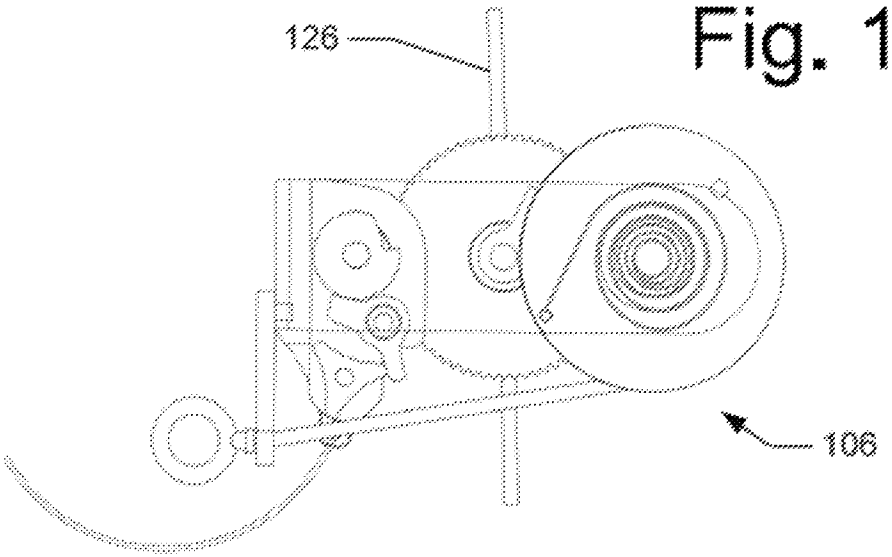
FIGS. 1A-C depict an illustrative compound bow with a power assist system.

The limbs of a compound bow are generally much stiffer than those of a recurve bow or a longbow. This limb stiffness may make the compound bow more energy efficient than other archery bows when used in conjunction with the pulley/cams as employed in modern compound bow construction. As force is applied when an archer draws the bow, the archer has a reduced mechanical advantage. However, during the draw as the pulley or cams rotate, and the archer gains mechanical advantage over the bending limbs, more energy is stored in the limbs in comparison to other archery bows. In general, this leveraging system gives the compound bow a characteristic draw-force curve, which rises to a peak weight, and then, lets off, or reduces dramatically to a lower holding weight. This feature of the compound bow permits the archer to draw the arrow and then maintain aim on their target, prior to the release of the arrow, for a longer period of time thereby resulting in a better aimed shot.

However, one of the chief shortcomings to the compound bows that have been developed so far is that the strength required by the archer to draw the string or cable to an arrow release position steadily increases as the bow strength increases. While the assorted cams and other leverage achieved by the previous compound bow designs have reduced the amount of strength that the archer needs to have to hold the string at a full, arrow release position, the archer must still have a certain amount of strength, which will permit the archer to first draw the arrow, and then return the arrow from an arrow release position, to an at rest position in the event that the archer does not release the arrow at a target. Often bringing a compound bow back to an at rest position, from a previous, fully drawn position often requires a bit of strength, and talent, in order to prevent uncontrolled movement of the bow as the arrow is being returned. This is particularly important to hunters, especially when an archer is shooting from a camouflaged position, or from a tree stand, and the like, and where an excessive amount of movement of the bow could have the effect of scaring-off a potential animal target.

Various embodiments contemplate that a compound bow may feature an ability to pre-store energy before the drawing back of a draw string. Various embodiments contemplate that this may allow an archer to draw back the draw string to store energy in the bow by bending the limbs, and upon reaching the let off region of the compound bow's draw profile, cause the pre-stored energy to be added to the energy being stored in the bending limbs. Various embodiments contemplate that this addition of pre-stored energy may give the archer more energy, held in the draw string, to transfer to an arrow upon release, propelling the arrow at greater speeds than would have been achieved with a compound bow of equal draw weight that does not feature an energy storage mechanism for pre-storage of energy.

Various embodiments contemplate that propelling an arrow at greater speeds may provide for a more humane harvest by increasing the velocity and accuracy of an arrow. For example, an increased velocity may provide an associated increase in kinetic energy at impact producing greater penetration than would be possible by a compound bow of equal draw weight that does not feature an energy storage mechanism for pre-storage of energy. Additionally or alternatively, various embodiments contemplate that an arrow which flies faster can maintain a flatter trajectory over a greater distance than a slower traveling arrow. This may enable a faster flying arrow to be fired more accurately than a slower traveling arrow. These factors alone or in combination may provide for a cleaner and more rapid harvest.

Additionally or alternatively, an energy storage mechanism for pre-storage of energy may enable groups of bow users who have traditionally used bows of lower relative draw weight to increase the effective draw weight and associated velocity of an arrow. For example, often bows of lower draw weight have traditionally been marketed towards women and youths. For example, an addition of an energy storage mechanism for pre-storage of energy may be added to a youth bow, or a regular sized bow that may be weighted to a level comparable to a youth bow, and may enable the bow to reach a much higher arrow velocity.

Illustrative Bow with Power Assist System

Figure 1C:
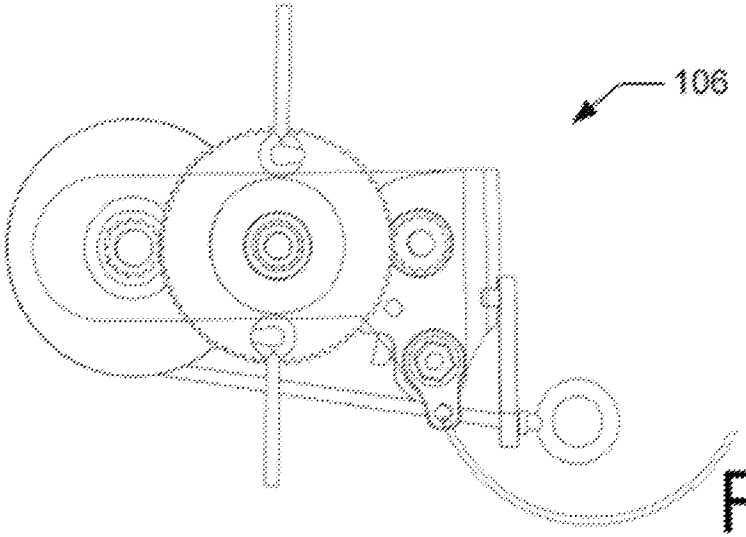
Figure 1A:
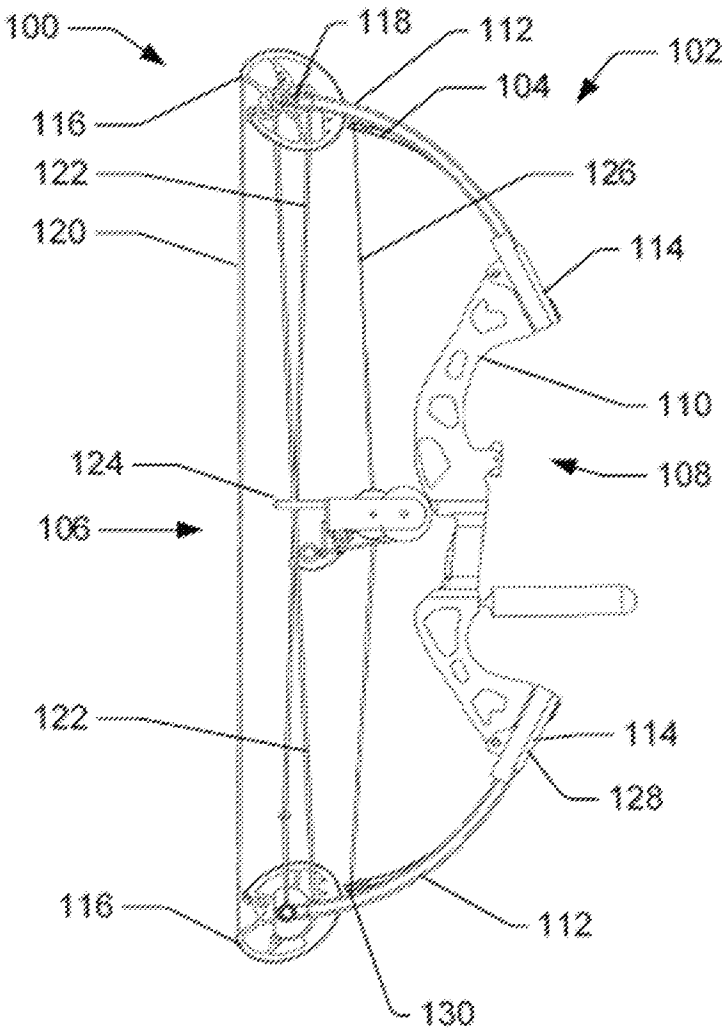

FIG. 1A depicts an illustrative compound bow 100 with a power assist system 102. In one embodiment, the power assist system 102 may include a resilient auxiliary member 104 and a loading mechanism 106. The compound bow 100 may include a central body or central mount region 108, which may include a riser 110, where bow components may be mounted including, but not limited to, limbs, sights, stabilizers, and quivers. FIG. 1A also shows limbs 112 of the bow coupled to the riser 110 at mount location 114. The limbs 112 may comprise a solid limb and/or a split limb configuration. Often the limbs 112 mounting may be adjusted at the mount location 114. Often attached to the limbs are cams, wheels, or a combination thereof. For example, different bows may have different bow eccentricities including, but not limited to, single cam, hybrid cam, dual cam, binary cam, quad cam, and hinged. For example, FIG. 1A shows an example of a dual cam where a cam 116 is coupled to limb 112 at mount location 118. Cam 116 may take various forms that may influence a force draw profile of the bow. The bow may often have at least two cams 116 that may be connected through various means including, but not limited to, strings, cables, lines, wires, or the like. For example, bow 100 may include a draw string 120 that may be drawn or pulled to various positions. Additionally, a projectile including an arrow (not shown) may be nocked to the string 120. The cams 116 may also be coupled by buss cables 122. The buss cables 122 may be attached to the cams 116 and/or at or near the mount location 118. The buss cables may also be displace laterally from the center of the bow 100 by a buss cable bar and/or guide 124.

When the draw string 120 is moved from an at rest position as shown in FIG. 1A, the draw string 120 may cause the cams 116 to rotate that may cause buss cables 122 to wrap around a portion of the cams 116 placing an additional tension force on draw string 120 and buss cables 122. This additional tension force may cause limbs 112 to bend and where mount locations 118 may move closer to each other while mount positions 114 may remain relatively fixed. The bending of limb 112 may store the potential energy used to accelerate a projectile as is understood by one of ordinary skill in the art. As the draw string 120 is drawn back towards an arrow release position (not shown) and the cams 116 continue to rotate, the cam 116 shape provides a mechanical advantage where the force required to draw the draw string 120 back may be reduced or "let off" as the draw string 120 reaches the release position.

Bow 100 may be constructed using various materials. For example, riser 110 may be aluminum, aluminum alloy, magnesium alloy, composites, or a combination thereof. The limbs 112 may be made from various resilient materials including, but not limited to, composite materials. Often the limbs may be designed with various composite materials to be capable of taking high tensile and compressive forces in various configurations. Draw string 120 and buss cables 122 may comprise high-modulus polyethylene, polyester, natural materials, plastic-coated steel, among others, and designed to have great tensile strength and minimal stretchability.

FIG. 1A also shows an illustrative embodiment of a power assist system 102 comprising a resilient auxiliary member 104 and a loading mechanism 106. The loading mechanism may be coupled to the auxiliary member 104 through a connector, for example, load cable 126. It is understood that the connector may comprise a member with a high tensile strength and low buckling strength such as a string, cable, wire, or the connector may comprise a member with a high tensile strength and a high buckling strength such as a ridged link comprised of a metallic or composite material. It is contemplated that materials and properties used in the buss cables as discussed above may be utilized for load cable 126.

Further, auxiliary member 104 may comprise an auxiliary limb configuration where auxiliary member 104 may be fixably coupled at a first end 128 at mount location 114 and displacably coupled to the loading mechanism 106 at a second end 130. Various embodiments contemplate that auxiliary member 104 may be disposed between two limbs 112 of a split limb configuration of bow 100. Various embodiments contemplate that auxiliary member 104 may comprise various resilient materials including, but not limited to, composite materials. Various embodiments contemplate that auxiliary member 104 may be designed with various composite materials to be capable of taking high tensile and compressive forces in various configurations. This may allow auxiliary member 104 to store and transfer or expel energy depending on the relative positions of first end 128 and second end 130. For example, if auxiliary member 104 is bent from a rest position, auxiliary member 104 may store an amount of energy. If auxiliary member 104 returns to a rest position, the stored amount of energy may be transferred or expelled.

FIG. 1A also shows an illustrative embodiment of loading mechanism 106 coupled to auxiliary member 104 through load cable 126. In this embodiment, loading mechanism 106 is located between a distal pair of auxiliary members 104 and as well as between a distal pair of limbs 112 and coupled to riser 110. FIGS. 1B-C show a portion of loading mechanism 106 from opposite sides. For example, FIG. 1B shows a portion of loading mechanism 106 from the same side as shown in FIG. 1A while FIG. 1C shows the same portion of loading mechanism 106 from the opposite side. FIGS. 1A-C show the respective portions of loading mechanism 106 at an at rest position without an auxiliary load applied.

Figure 2B:
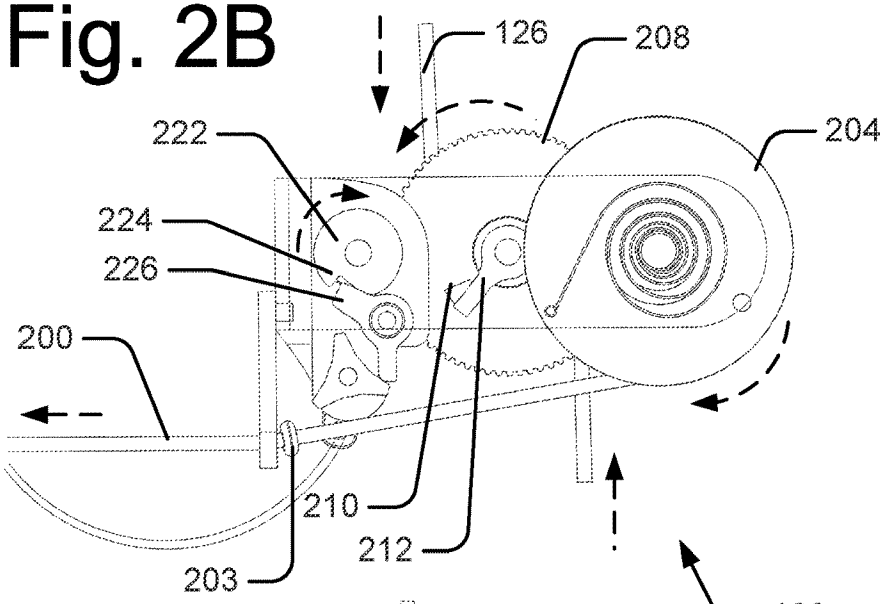
FIGS. 2A-8C depict the illustrative compound bow with a power assist system of FIGS. 1A-C in various positions.
Figure 2C:
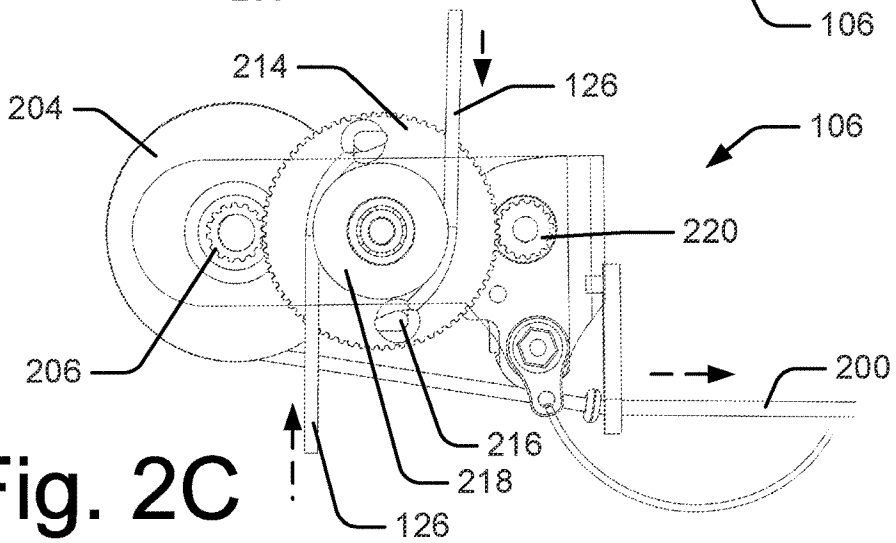
Figure 2A:
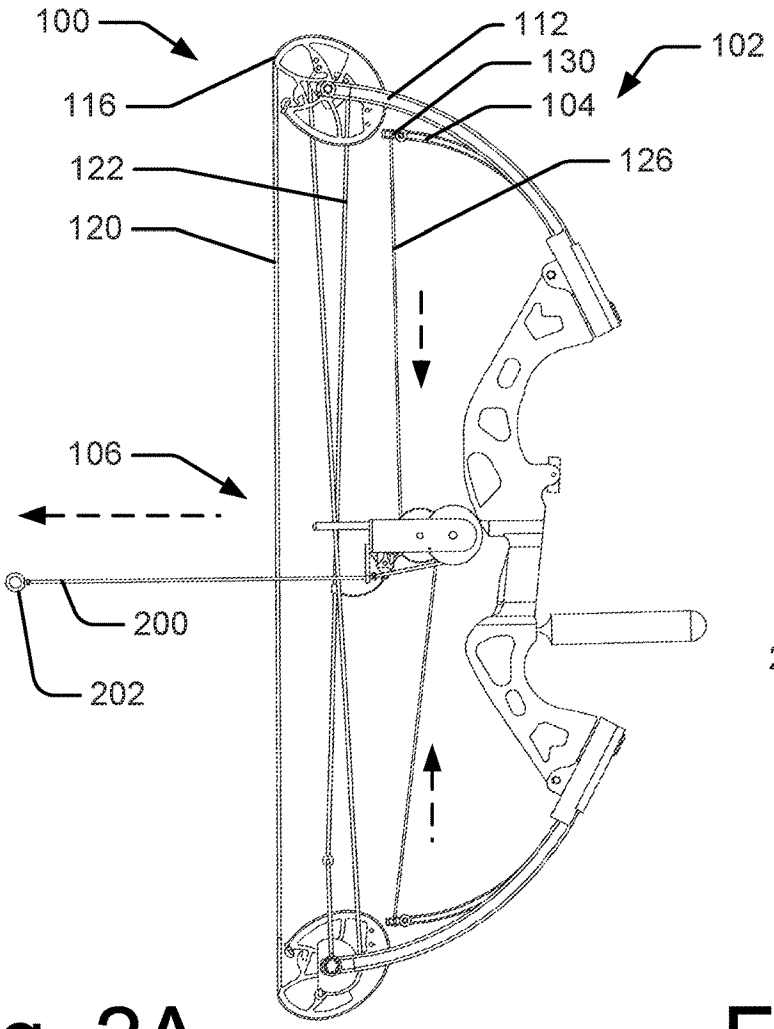

FIGS. 2A-C show the illustrative embodiment of FIG. 1A after an auxiliary load has been applied and energy stored in auxiliary member 104. The dotted arrows indicate various relative movement of various components from the state shown in FIGS. 1A-C to reach the state shown in FIGS. 2A-C. Various embodiments contemplate that loading mechanism 106 may comprise a power loading string 200. It is contemplated that power loading string 200 may comprise any suitable material including, but not limited to, the materials used as draw strings and or cables. Various embodiments contemplate that power loading string 200 may be actuated by applying a loading force to a first end 202. Various embodiments contemplate that a user may temporarily secure themselves to the first end 202 by hand, trigger release, wrist-trigger release, or other suitable action. It is contemplated that displacement of the power loading string 200 may be limited by an extension limiter 203 that may be disposed on power loading string 200 at a location to engage a stop at the desired position. Various embodiments contemplate that the extension may be limited to a distance greater or less than a user's normal pull. Various embodiments contemplate that the extension may be limited to a range of 60%-90% of a user's normal pull. Additionally or alternatively, various embodiments contemplate that the extension may be limited to a range of 70%-80% of a user's normal pull.

It is also contemplated that the power loading string 200 is coupled at a second end (not numbered) to a gear or set of gears. For example, FIG. 2B shows power loading cable 200 coupled to power spool 204. In FIG. 1B, the power loading cable 200 was wrapped around an inner surface (not shown) of power spool 204. Displacement and extension of the first end 202 of the power loading string 200 may cause the rotation of the power spool 204, which may be coupled to a reducing gear 206 that may share a same axis alignment. Gear 206 may engage and turn gear 208. Gear 208 may have a power transfer boss 210 coupled to it. As gear 208 turns, boss 210 may engage and turn arm 212. Arm 212 may be coupled to an axel freely rotatably extending through gear 208 and coupled to power loading gear 214. Power loading gear 214 may be coupled to auxiliary member 104 through load cable 126. Load cables 126 may be fixedly attached to power loading gear 214 at attachment location 216. The attachment location may allow the load cables 126 to rotate and/or pivot. Power loading gear 214 may also have a surface 218 that may constrain the location of the load cables 126 as the power loading gear 214 rotate. Additionally or alternatively, surface 218 may be cylindrical or cam-shaped to provide additional leverage at various positions of the loading.

Further, the rotation of power loading gear 214 may cause the load cables 126 to displace from an initial position shown in FIGS. 1A-C. This displacement may cause a tension and or an additional tension load on load cables 126. This tension and displacement may cause a displacement of the second end 130 of auxiliary member 104. This displacement may cause energy to be stored in the auxiliary member 104. It is noted that this may cause the second end 130 of the auxiliary member 104 to move away from limb 112. Various embodiments contemplate that the displacement of the second end 130 be congruent and/or consistent with the displacement of the limbs 112 as per a design of the bow 100. This may range from greater than zero inches to less than five inches. Additionally or alternatively, various embodiments contemplate a displacement between one and two inches.

Additionally or alternatively, the power loading gear 214 may engage gear 220 as shown in FIG. 2C. Gear 220 may cause ratchet 222 to rotate to its position shown in FIG. 2B having at least one tooth 224. Rotation of ratchet 222 may move tooth 224 into a position such that pawl 226 may engage tooth 224 to selectively prevent ratchet 222 from rotating in the opposite direction. This may in effect lock affected gears in place and keep the auxiliary member 104 in position if the force on power loading string 200 is removed.

Additionally or alternatively, various embodiments contemplate more than one tooth 224 coupled with alternate gearing to provide for multiple pulls on the power loading string 200 to fully load or displace the auxiliary members 104.

Figure 3B:
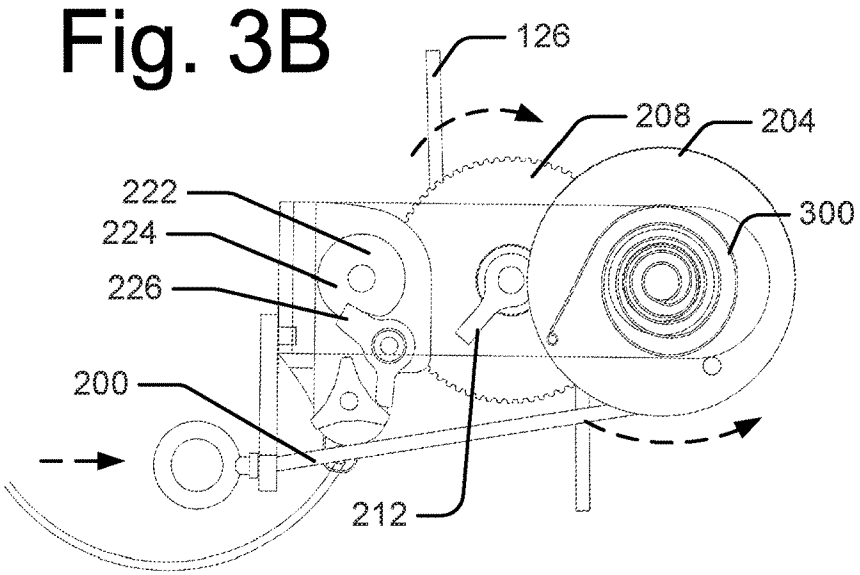
Figure 3C:
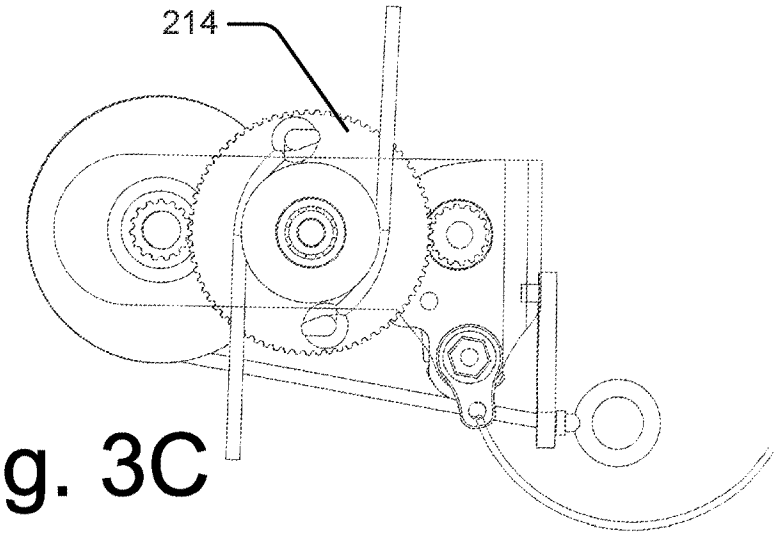
Figure 3A:
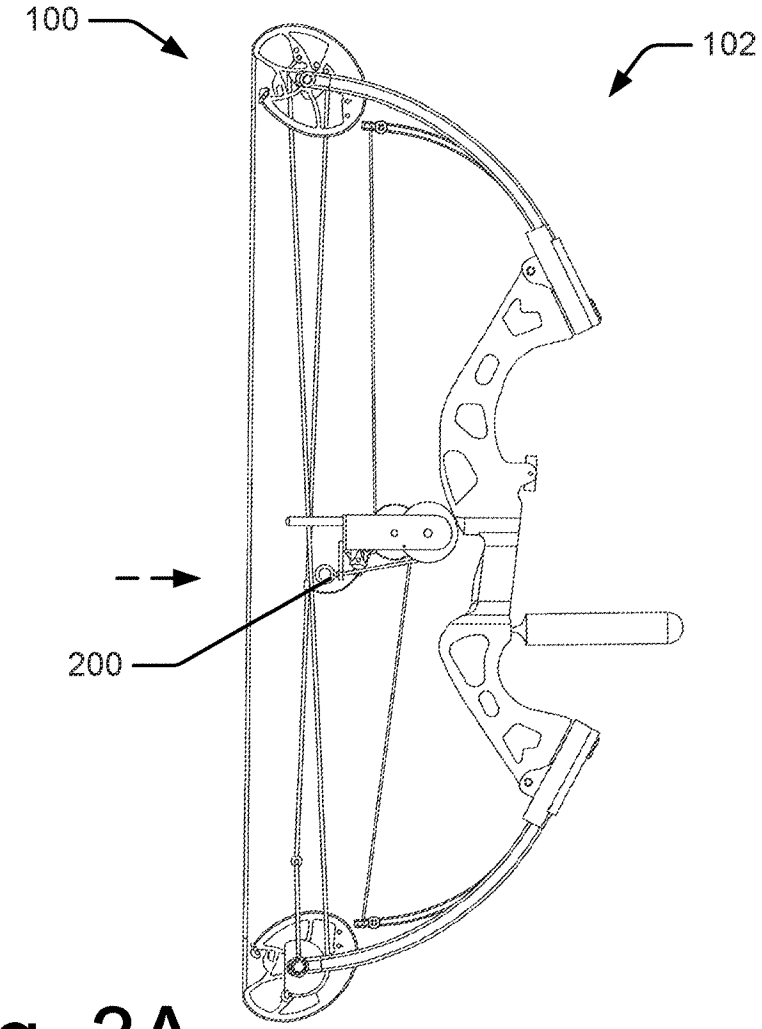

FIGS. 3A-C show the illustrative embodiment of FIGS. 1A and 2A after an auxiliary load has been applied and energy stored in auxiliary member 104 and the power loading string 200 retracted. Various embodiments contemplate that power loading string 200 may be retracted by a retraction mechanism 300 and would around power spool 204. Retraction mechanism may comprise any suitable mechanism for retracting a cable or a string. For example, FIG. 3B shows retraction mechanism as a constant force spring. The retraction mechanism may have some potential energy stored in it as part of the initial retraction of power loading string 200. This potential energy stored may be used to retract the power loading string 200.

Additionally or alternatively, this retraction of power loading string 200 may cause power spool 204 to rotate, which may in turn cause gear 208 to rotate moving boss 210 (not shown) away from arm 212.

Additionally or alternatively, this retraction may cause gear 208 to partially remove the load applied by arm 212 to power loading gear 214. This may cause power loading gear 214 to slightly rotate under the force of load cables 126 to slightly rotate ratchet 222 and cause tooth 224 to more firmly engage pawl 226.

Figure 4B:
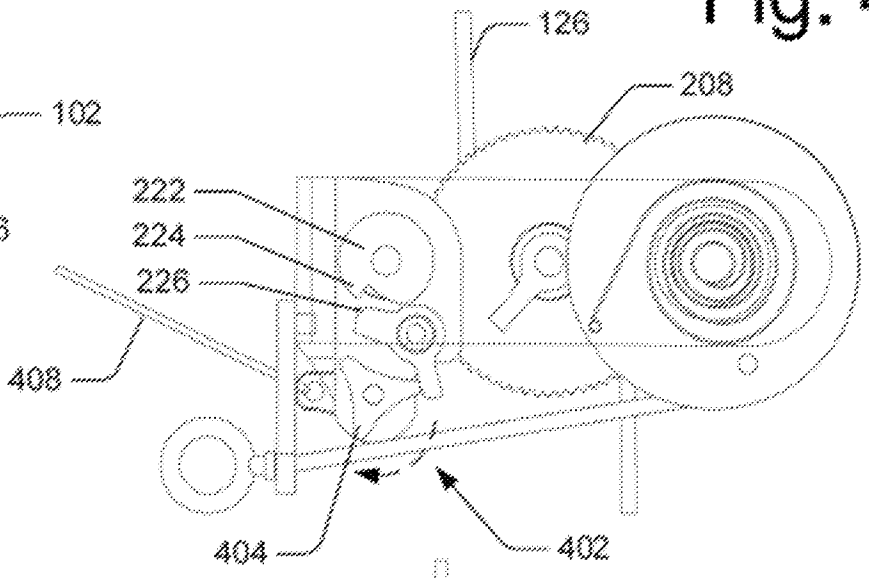
Figure 4C:
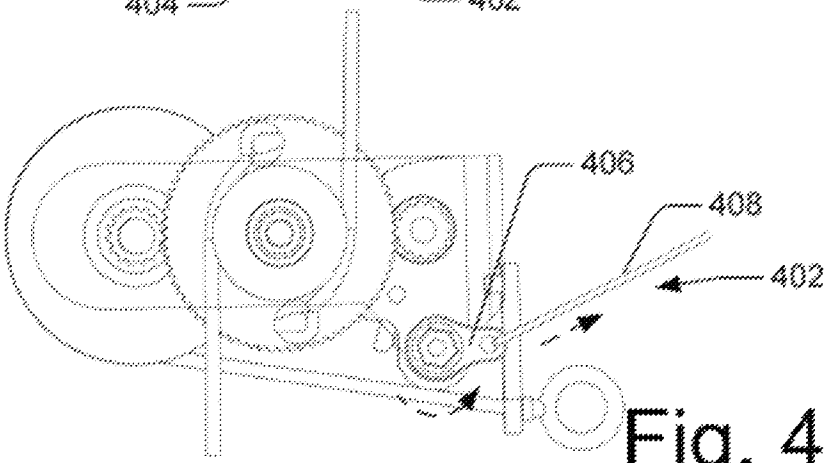
Figure 4A:
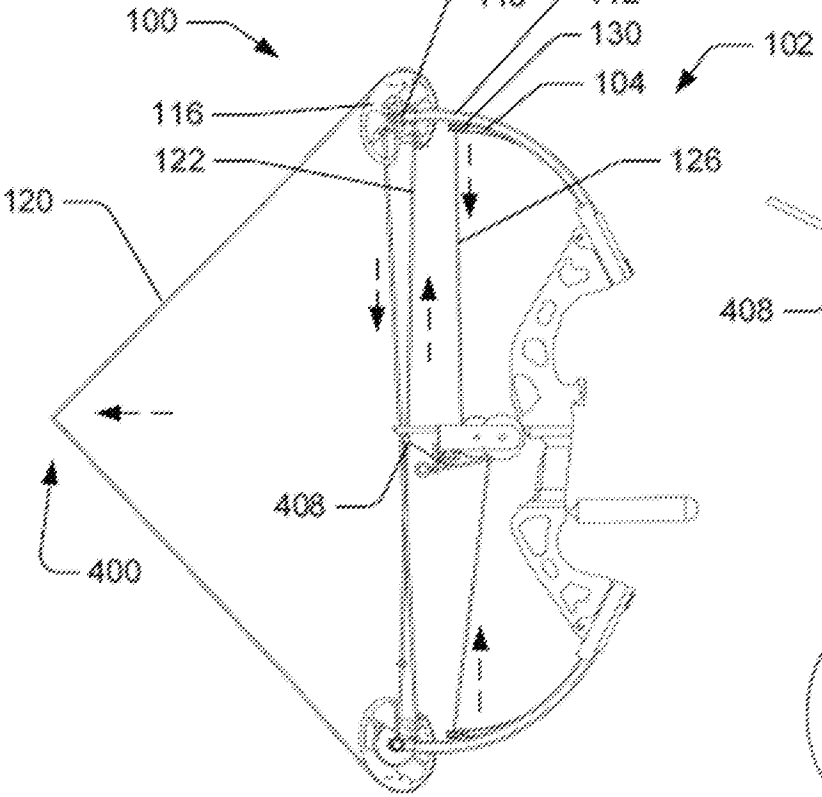

FIGS. 4A-C show the illustrative embodiment of FIGS. 1A and 3A after an arrow (not shown) may have been nocked (loaded) and the draw string 120 drawn to a release position 400. For example, FIG. 4A shows that displacement of draw string 120 may cause cams 116 to rotate causing the buss cables 122 to wrap around a portion of the cams 116 placing an additional tension force on draw string 120 and buss cables 122. This additional tension force may cause limbs 112 to bend and where mount locations 118 may move closer to each other. The bending of limb 112 may store the potential energy used to accelerate a projectile as is understood by one of ordinary skill in the art. As the draw string 120 is drawn back towards an arrow release position (not shown) and the cams 116 continue to rotate, the cam 116 shape provides a mechanical advantage where the force required to draw the draw string 120 back may be reduced or "let off" as the draw string 120 reaches the release position. This let off may be characterized as a percentage of the load placed on the limbs 112. This percentage may vary between 0% and 100%. However, it is common for a compound bow to have a let-off percentage of between 50-90%.

Additionally or alternatively, as the cams 116 rotate and cause limbs 112 to displace, the limbs 112 may engage auxiliary member 104. For example, the limb 112 may begin to be displaced as discussed above. At a point prior to draw string 120 reaching release position 400, the displacement of limb 112 may be sufficient to engage the second end 130 of auxiliary member 104. As such, when the draw string 120 reaches the release position 400, the limbs 112 keep auxiliary member 104 displaced and release some or all of the tension in load cables 126. Also prior to the draw string 120 reaching the release position 400, cams 116 may have rotated sufficiently such that the force required to continue to move draw string 120 toward release position 400 is sufficiently reduced as part of the "let off" of the bow. Various embodiments contemplating that the bow being drawn enters the let-off region prior to engaging auxiliary member 104. In these embodiments, the let off percentage may be applied to the combined load of the limbs 112 and auxiliary member 104. As such, a user, for example an archer, may advantageously position and hold a force on bow 100 at a release position 400 much greater than the user may have been able to without the power assist system 102.

Additionally or alternatively, as the cams rotate causing the buss cables 122 to displace as the draw string 120 is drawn to the release position 400, a lock control mechanism 402 may be activated to release pawl 226 and disengage pawl 226 from ratchet 222. This may allow the full amount of energy stored in the auxiliary members 104 to be transferred to limbs 112 when the draw string 120 is released from the release position to, for example, fire an arrow.

Various embodiments contemplate that lock control mechanism 402 may comprise a gear 404 that may selectively hold pawl 226 engaged with ratchet 222 or may allow pawl 226 to disengage from ratchet 222. For example, gear 404 may be coupled to an arm 406 that may cause gear 404 to selectively rotate. Arm 406 may be coupled to the draw string 120 directly or indirectly. For example, arm 406 may be coupled to a tether 408 that is attached to buss cable 122. As buss cable 122 is displaced due to displacement of the draw string 120, the tether 408 may cause arm 406 to rotate gear 404 to rotate to a position causing and/or allowing pawl 226 to rotate to a position to disengage from ratchet 222.

Figure 5B:
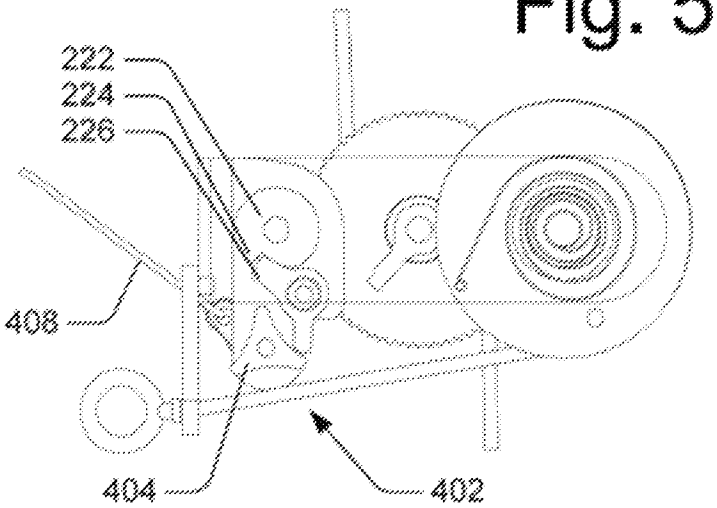
Figure 5C:
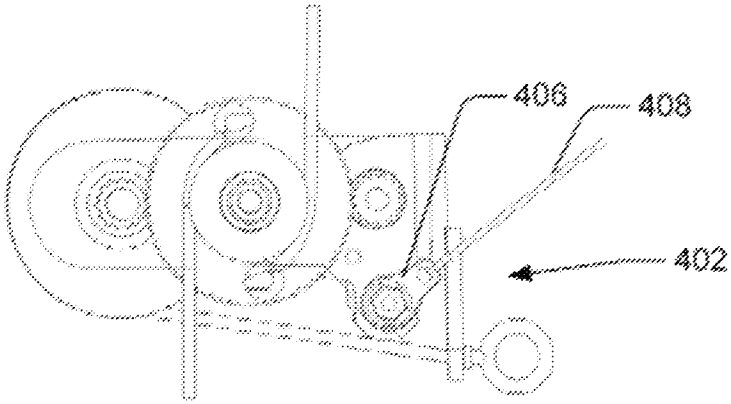
Figure 5A:
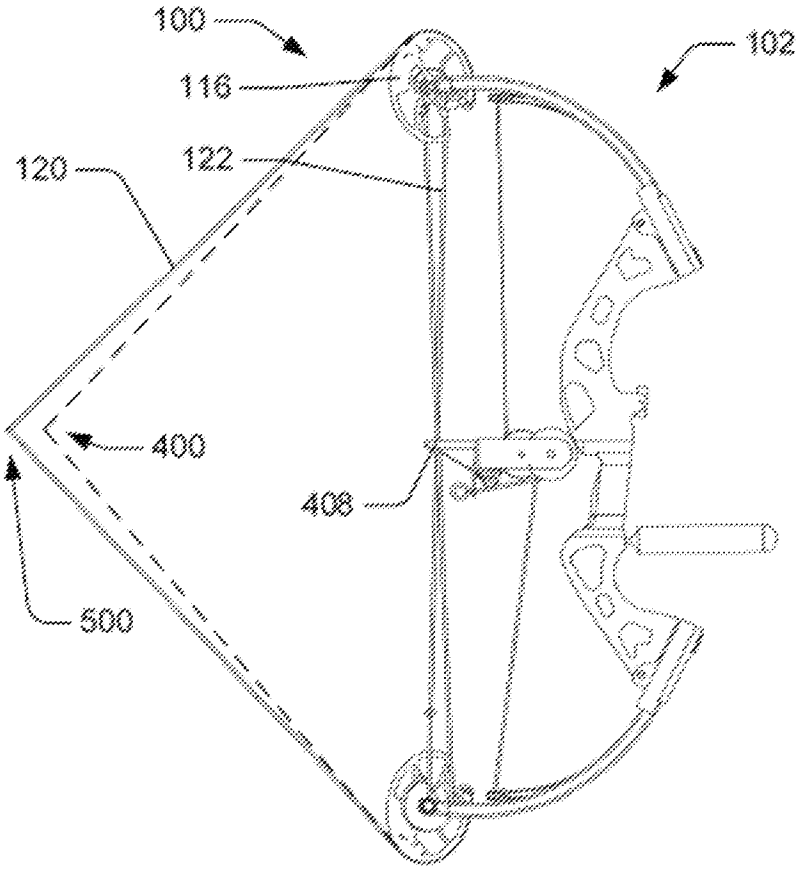

FIGS. 5A-C show the illustrative embodiment of FIGS. 1A and 4A after an arrow (not shown) may have been nocked (loaded) and the draw string 120 drawn to a return position 500. For example, FIG. 5A shows that displacement of draw string 120 may cause cams 116 to rotate causing the buss cables 122 to wrap around a portion of the cams 116 placing an additional tension force on draw string 120 and buss cables 122. This additional tension force may cause limbs 112 to bend and where mount locations 118 may move closer to each other. Various embodiments contemplate that the return position 500 is further from the rest position than the release position 400. However, other configurations are contemplated including, but not limited to, a return position 500 that is the same as or closer to the rest position than release position 400. Various embodiments contemplate that the return positions is between one half and one and one half inches past the release position. Various embodiments contemplate that the return position is an inch past the release position.

Additionally or alternatively, as the cams rotate causing the buss cables 122 to displace as the draw string 120 is drawn to the return position 500, a lock control mechanism 402 may be activated to engage pawl 226 with ratchet 222. This may allow the amount of energy stored in the auxiliary members 104 to be kept in the auxiliary members 104 as limbs 112 are returned to an at rest position, for example, not fire an arrow, but return the arrow to the at rest position.

Various embodiments contemplate that buss cable 122 may continue to be displaced further displacing tether 408 causing arm 406 to rotate gear 404 into a position causing pawl 226 to rotate to a position to engage with ratchet 222.

Figure 6B:
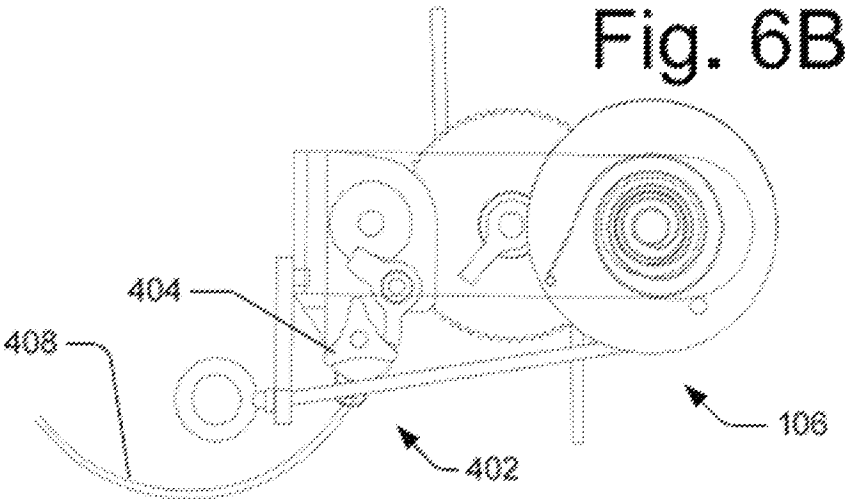
Figure 6C:
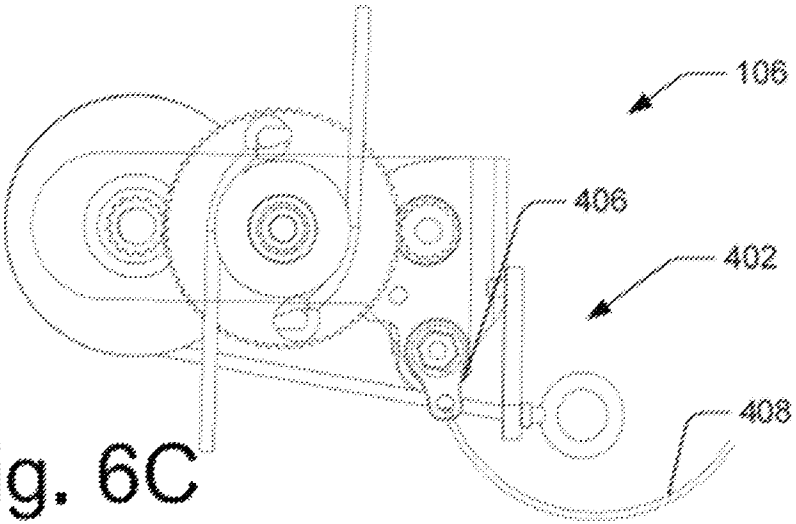
Figure 6A:
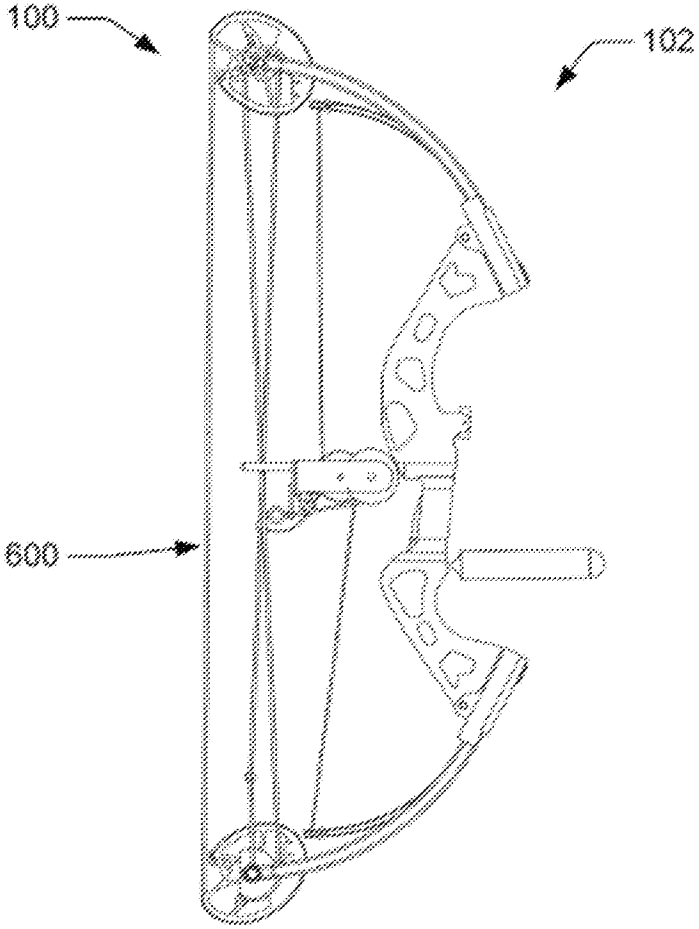

FIGS. 6A-C show the illustrative embodiment of FIGS. 1A and 5A after an arrow (not shown) may have been nocked (loaded) and the draw string 120 drawn to a return position 500 and then to an at rest position 600. For example, FIG. 5A shows bow 100 is a configuration similar to FIGS. 3A-C. As discussed above however, the force on the draw string 120 during the movement to the at rest position from the return position is mainly limited to the force caused by the energy stored in the limbs 112. This may allow a user, for example, an archer, to return an arrow to an at rest position without exerting the level of strength and skill as commonly used with a compound bow without the power assist system 102. As noted above, a force from the auxiliary members 104 is applied to the limbs 112 and draw string 120 until the draw string 120 is returned sufficiently past the release position 400. For example, the draw string 120 may be past the release position 400 headed toward the at rest position, but still in the let off area of the draw stroke. As such, the force exerted by the auxiliary members 104 is removed from the limbs 112 as the cams 116 rotate causing limbs 112 to exert a higher force on the draw string 120.

FIGS. 6A-C also show that as the force on tether 408 is reduced, arm 406 is allowed to return to the position shown in FIGS. 6B and C. However, gear 404 may remain stationary to allow the lock to remain engaged. This may be accomplished by an internal ratchet coupling arm 406 to gear 404.

Figure 7B:
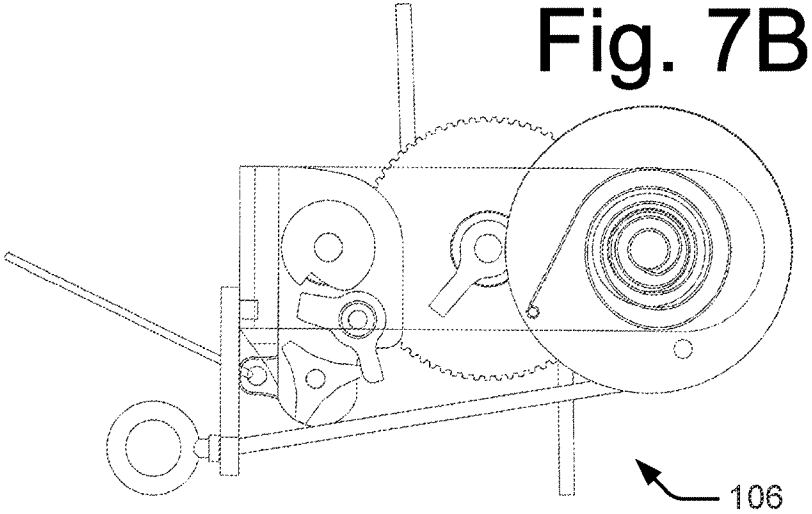
Figure 7C:
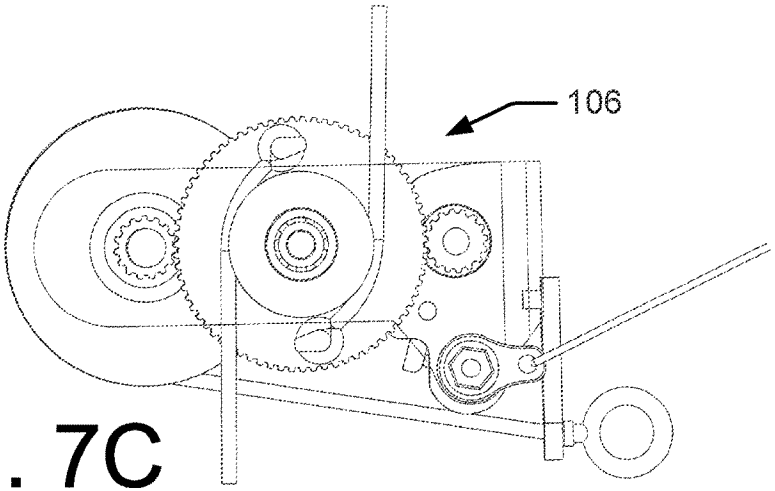
Figure 7A:
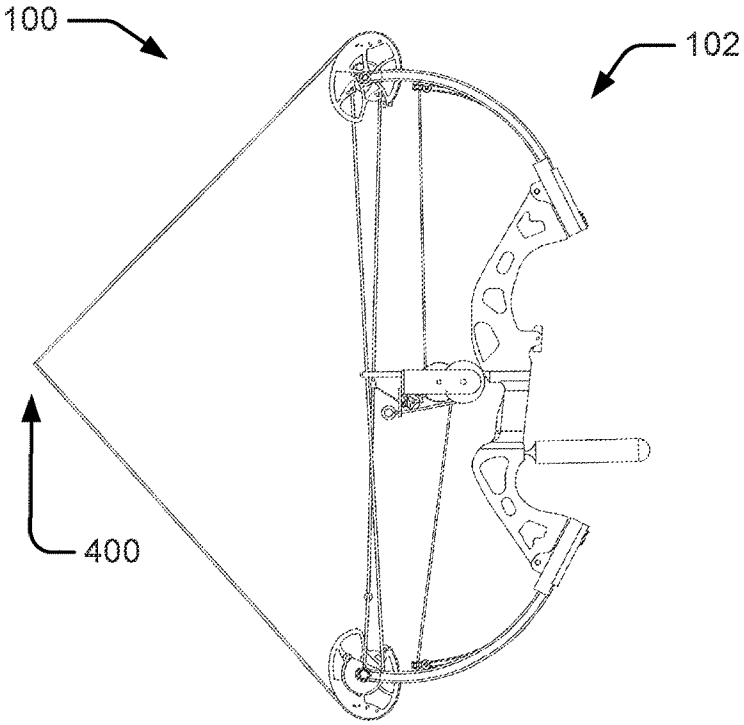

FIGS. 7A-C show the illustrative embodiment of FIGS. 1A and 6A after an arrow (not shown) may have been nocked (loaded) and the draw string 120 drawn to a release position 400 similar to the position described with respect to FIGS. 4A-C.

Figure 8B:
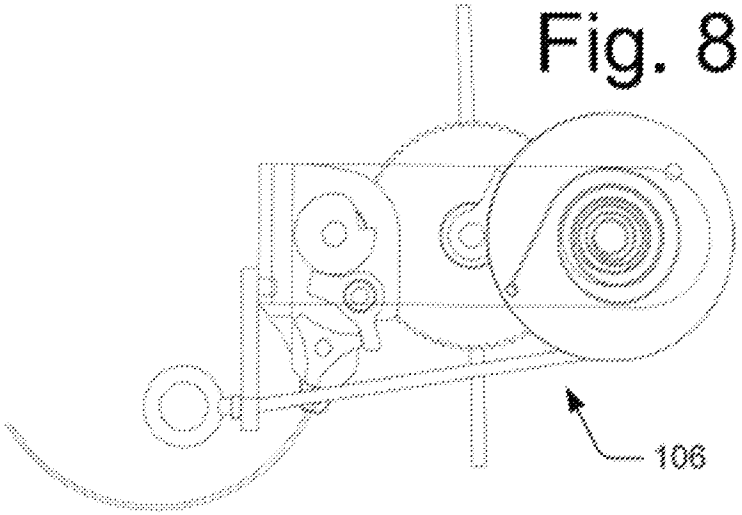
Figure 8C:
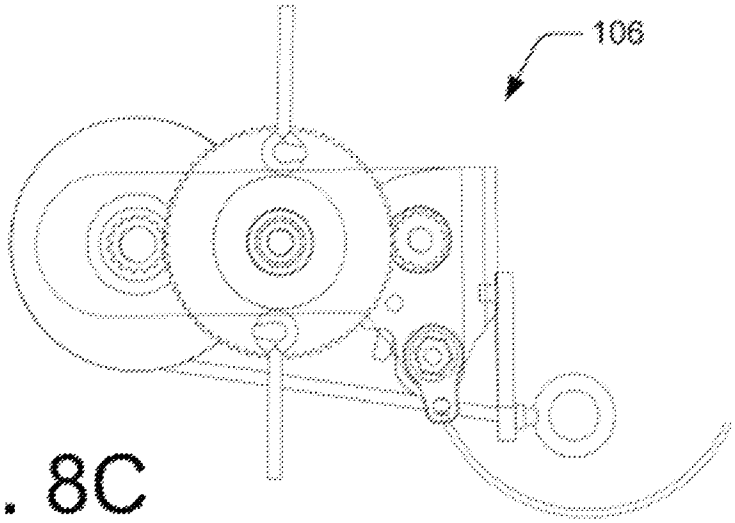
Figure 8A:
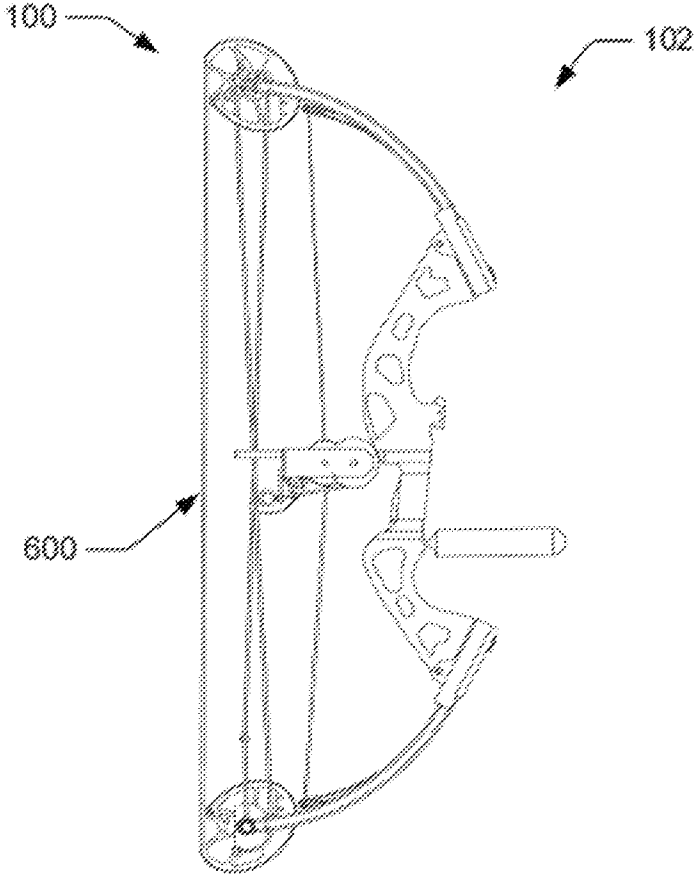

FIGS. 8A-C show the illustrative embodiment of FIGS. 1A and 7A after the draw string 120 may have been released applying a force to an arrow (not shown) to propel it. Various embodiments contemplate that the force applied to the arrow was supplied by the release of the energy from both the limbs 112 and the auxiliary members 104. As shown in FIGS. 8A-C the bow 100 and power assist system 102 are substantially returned to the configuration shown in FIGS. 1A-C. As such, the bow 100 and power assist system 102 are substantially ready to be used again.

Additionally or alternatively, when an arrow is released, a vibration may be generated by the bow and the bow components. Various embodiments contemplate that the interface between the auxiliary member 104 and the limbs 112 may be configured such that vibration in the limbs 112 is dampened by the auxiliary member 104 and/or the interface between the member 104 and the limbs 112.

Figure 9B:
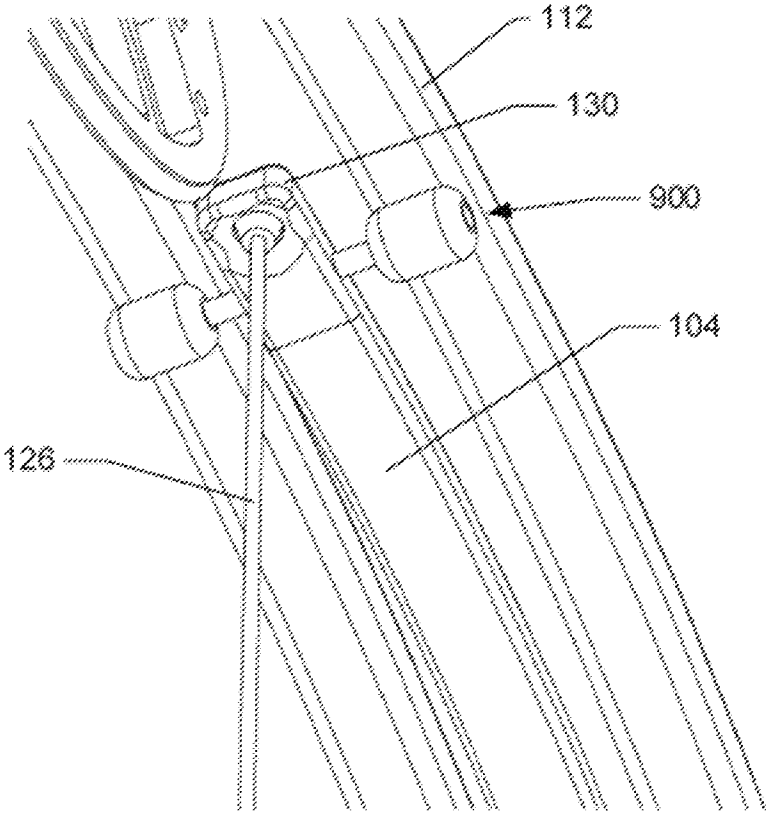
FIGS. 9A-B depict an illustrative interface of a compound bow with a power assist system.
Figure 9A:
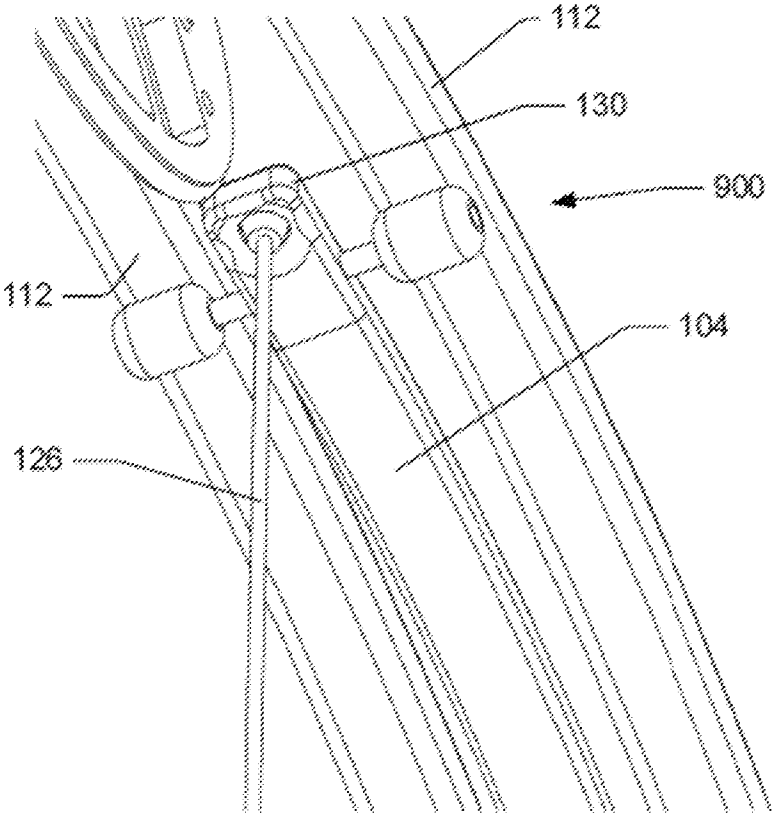

FIG. 9A shows an embodiment where the bow 100 is at the at rest position similar to that shown in FIG. 8. FIG. 9A shows that the auxiliary member 104 is engaged to limb 112 (limb 112 is shown as a split limb system). For example, FIG. 9A shows a engagement device 900. Engagement device 900 may be configured to engage limbs 112 and efficiently transfer energy stored in auxiliary member 104 as well as dampen out vibrations resulting from an arrow being released.

FIG. 9B shows an embodiment where bow 100 is drawn to a release position similar to that shown in FIG. 7. Similar to FIG. 9A, engagement device 900 may be configured to engage limbs 112 and efficiently transfer energy stored in auxiliary member 104 when the arrow is released and throughout the return to the at rest position.

Various embodiments contemplate that auxiliary member 104 may be preloaded with energy when positioned in the at rest position shown in FIG. 1A. This may have an effect of allowing a larger amount of energy stored in it and possibly provide a better power curve during loading as well as propelling an arrow when released. Further, this preloading may also have the capability to augment dampening of the system by applying a force to effectively engage engagement device 900 with limbs 112.

Additionally or alternatively, the coupling at auxiliary member 104 to the load cables 126 may be a fixed junction or may provide for an interface with a cam, pulley, or combination thereof.

Figure 10:
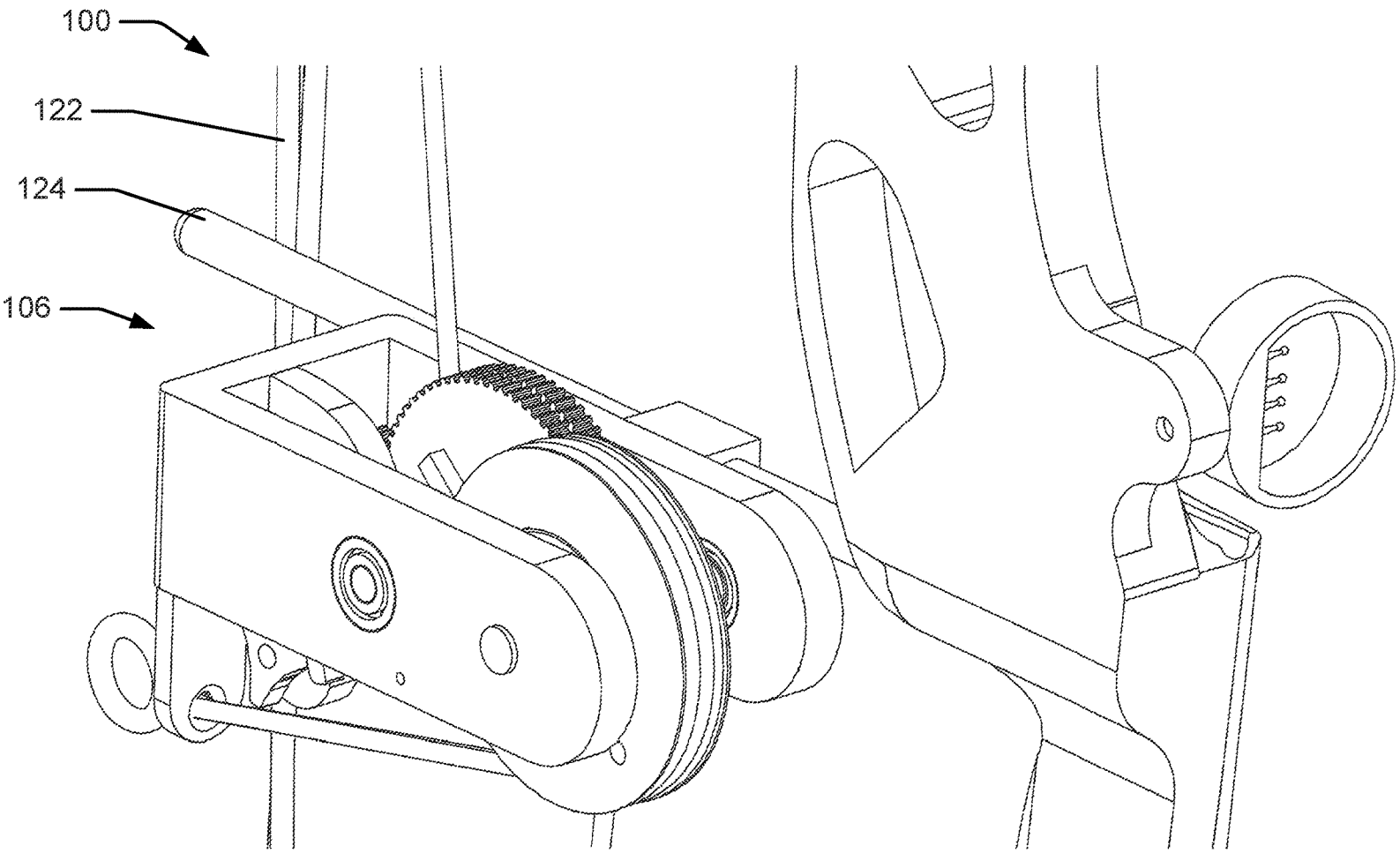
FIG. 10 depicts an illustrative perspective view of the compound bow with a power assist system of FIGS. 1A-C.

FIG. 10 shows a perspective view of the embodiment shown in FIG. 1A. Additionally or alternatively, various embodiments contemplate that the loading mechanism 106 may be removeably coupled to the bow 100. For example, loading mechanism 106 may be coupled to an existing buss cable guide. It is also noted that buss cables 122 may be positioned on the side of the bar opposite to what is shown in FIG. 10.

Figure 11:
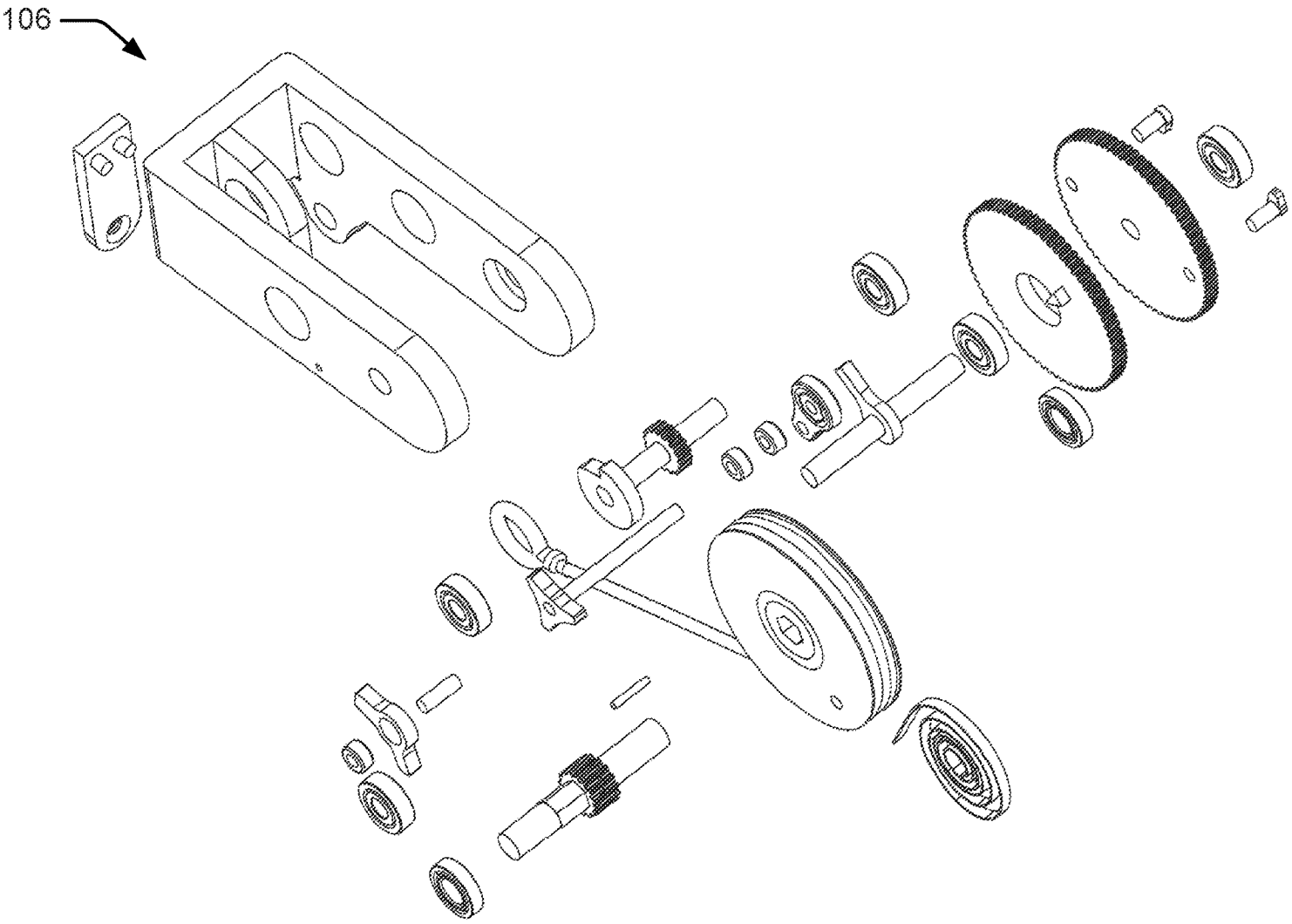
FIG. 11 depicts an exploded view of a portion of an illustrative power assist system.

FIG. 11 shows an exploded perspective view of illustrative loading mechanism 106.

Additional Illustrative Bow with Power Assist System

Figure 12B:
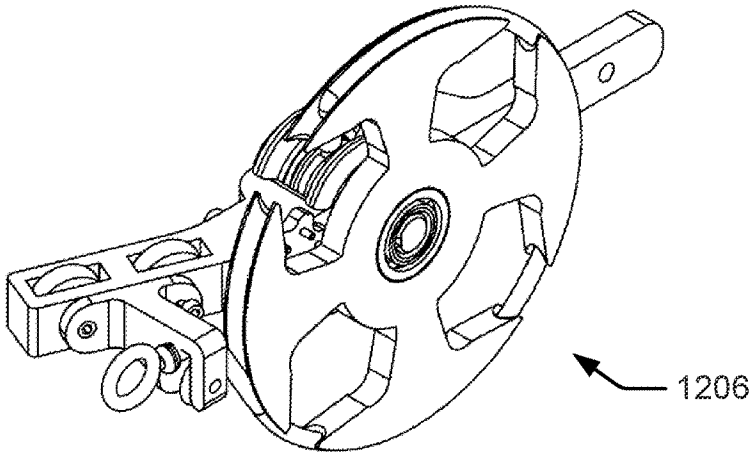
FIGS. 12A-C depict an additional illustrative compound bow with a power assist system.
Figure 12C:
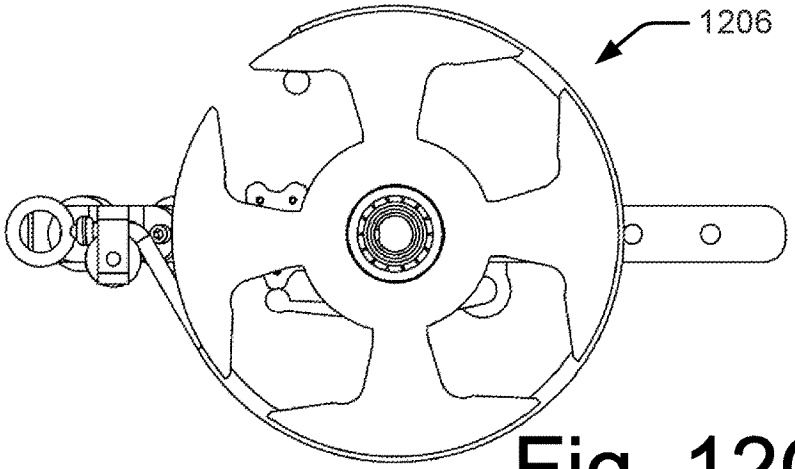
Figure 12A:
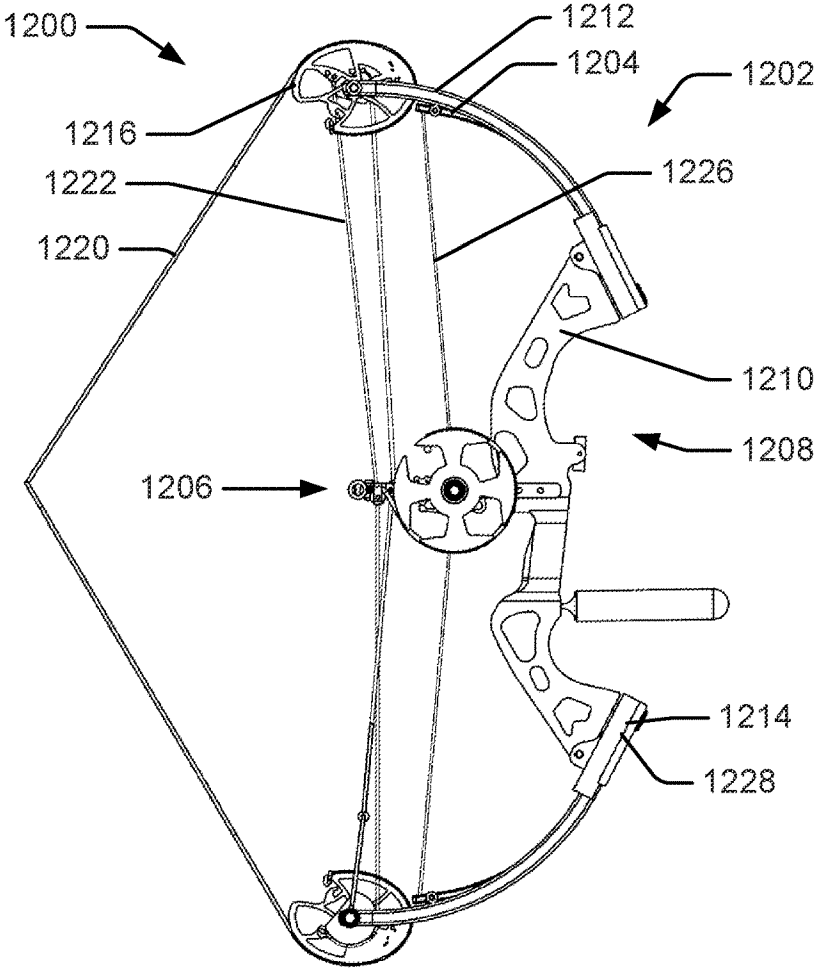

FIGS. 12A-B show an additional embodiment of an illustrative compound a bow 1200 with a power assist system 1202. Bow 1200 operates in the substantially the same way as bow 100 in terms of operation. As such, discussion of those operating features may be reviewed above. Additionally or alternatively, portions of power assist system 1202 operate similar to power assist system 102 discussed above. However, this embodiment contemplates that loading mechanism 106 operates differently is some capacities from loading mechanism 1206.

However, in the interest of brevity, operation of loading mechanism 1206 will be discussed with respect to positions of bow 100 discussed with respect to FIGS. 1A-8A.

Figure 13:
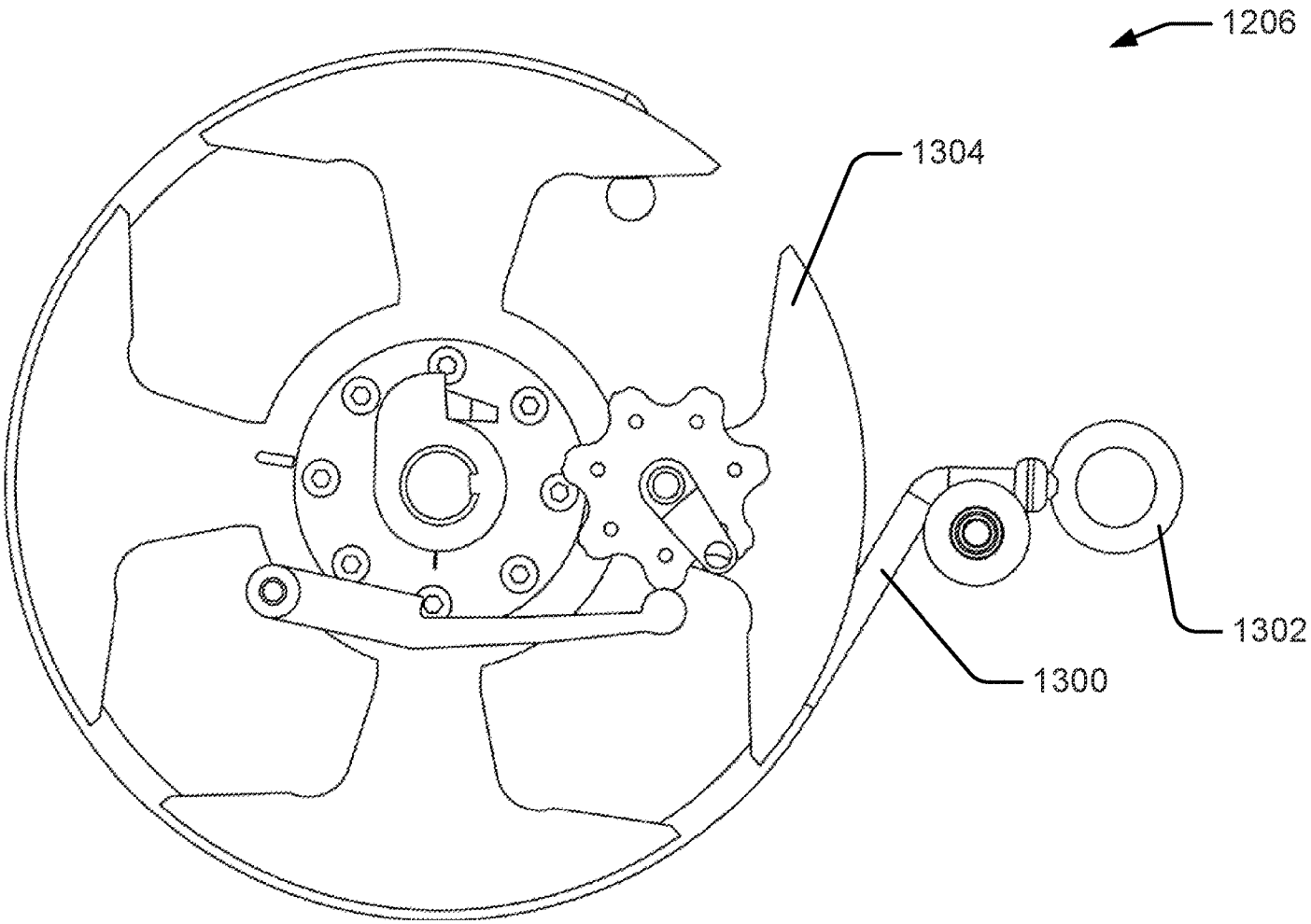
FIGS. 13-17 depict a portion of the illustrative compound bow with a power assist system of FIGS. 12A-C in various positions.

FIG. 13 shows loading mechanism 1206 while bow 1200 is at an at rest configuration similar to FIG. 1A. FIG. 13 also shows a pull cable 1300 with a first end 1302. As will be shown in the next figures, displacement of pull cable 1300 may cause pull cable wheel 1304 to rotate about its axis. Various embodiments contemplate that pull cable wheel 1304 may take various forms including, but not limited to a closed circle, a cam shape, or a combination thereof. Additionally or alternatively, pull cable wheel 1304 may provide a channel or groove about its exterior to maintain pull cable 1300 in proper position.

Figure 14:
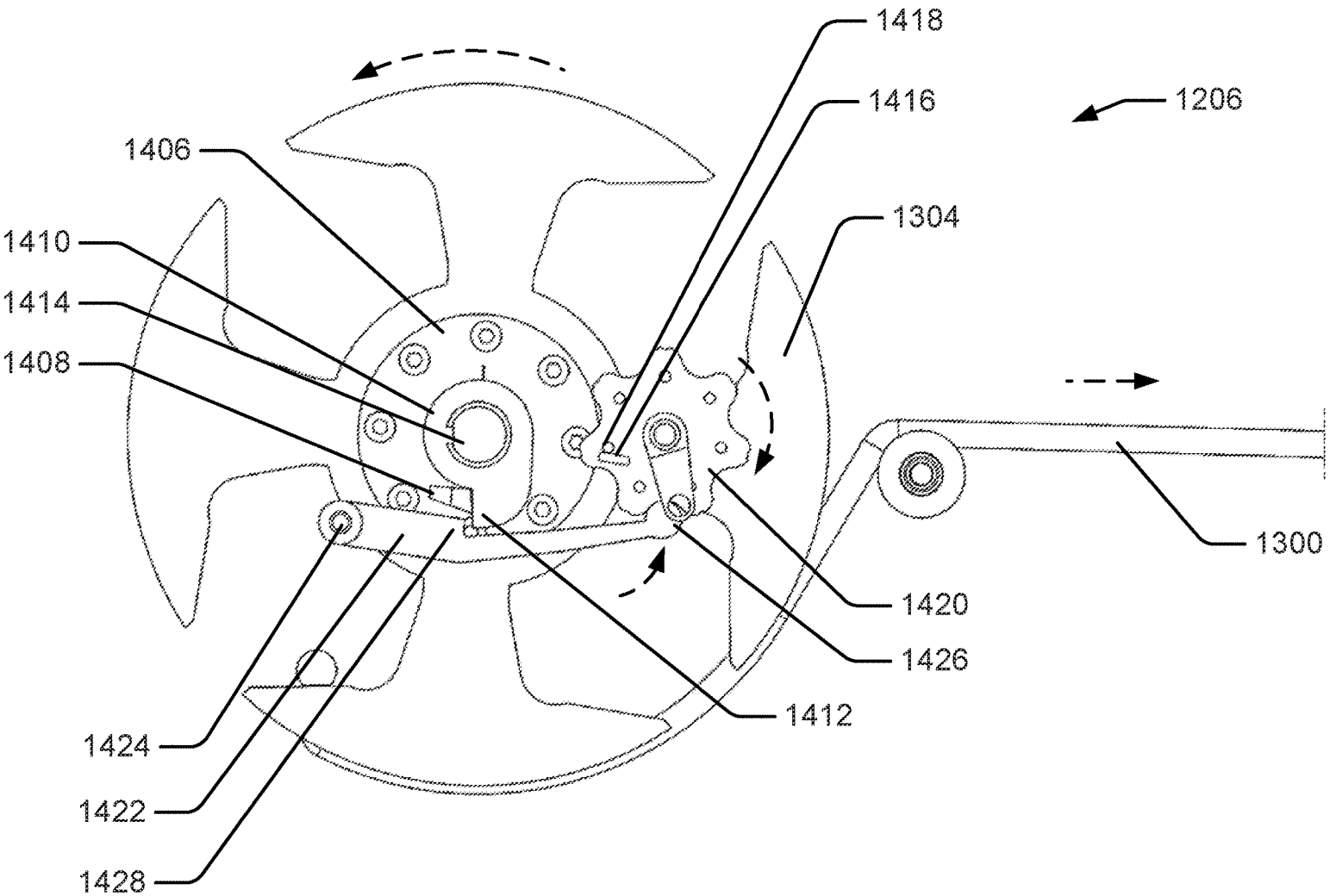

FIG. 14 shows loading mechanism 1206 after an auxiliary load has been applied and energy stored in auxiliary member 104 similar to FIG. 2A. FIG. 14 also shows a pull cable 1300 displaced causing pull cable wheel 1304 to rotate. Pull cable wheel 1304 in turn may cause a plate 1406 to rotate about its axis. Plate 1406 may comprise a boss 1408 that may engage a ratchet 1410 that may comprise at least one tooth 1412. Ratchet 1410 may engage a shaft 1414 and rotate shaft 1414 about its axis. Various embodiments contemplate that shaft 1414 may be coupled to a structure (shown in FIG. 18) similar in function to surface 218 as described with respect to FIGS. 2A-C that may couple to and cause a cables 126 (not shown) to displace storing energy in auxiliary members 104 (not shown).

Additionally or alternatively, rotation of pull cable wheel 1304 may cause a boss 1416 disposed on the pull cable wheel to rotate into and engage a pin 1418 on a toggle wheel 1420 causing toggle wheel 1420 to rotate. Boss 1416 may, in various embodiments be hidden by toggle wheel 1420 in the displayed position; however, boss 1416 is shown here for clarity. This rotation of toggle wheel 1420 may cause locking arm 1422 that may pivot at a point 1424 while anchored to support (not shown) to displace end 1426 into a valley or relief along a perimeter of toggle wheel 1420 as shown in FIG. 14. This displacement may cause locking arm 1422 to rotate into a position such that locking interface 1428 disposed on locking arm 1422 may selectively engage tooth 1412 of ratchet 1410.

Figure 15:
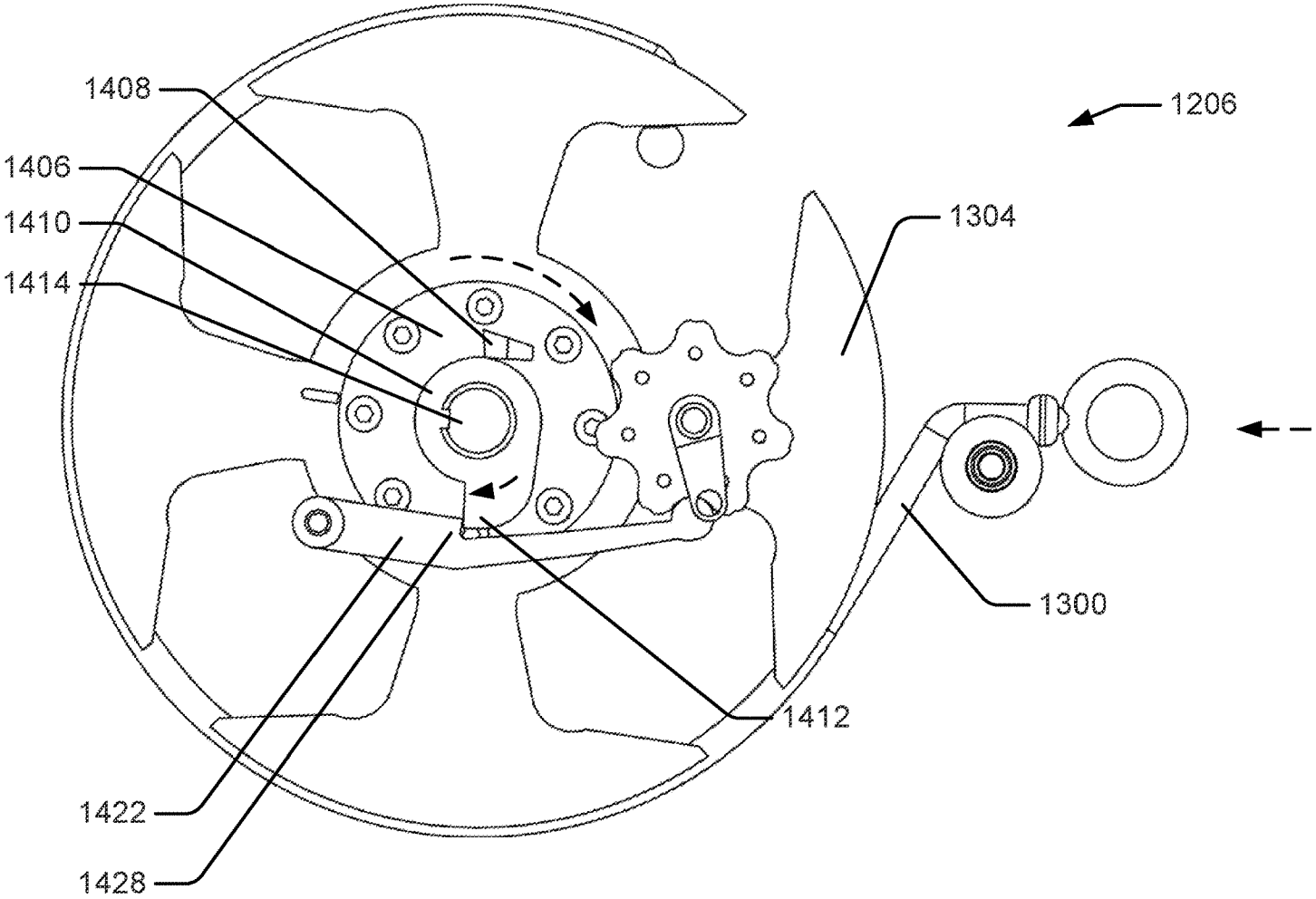

FIG. 15 shows loading mechanism 1206 after an auxiliary load has been applied and energy stored in auxiliary member 104 with the power loading string 200 retracted similar to FIG. 3A. FIG. 15 also shows a pull cable 1300 returned to an initial position. This may be facilitated by a retraction mechanism similar to retraction mechanism 300. Retraction of pull cable 1300 allows pull cable wheel 1304 to rotate causing boss 1408 to disengage from ratchet 1410. This allows ratchet 1410 to engage tooth 1412 of ratchet 1410 with locking interface 1428 of locking arm 1422. This engagement may selectively prevent ratchet 1410 from rotating which in turn may keep shaft 1414 from rotating which in turn may keep tension on auxiliary members 104 through load cables 126.

Figure 16:
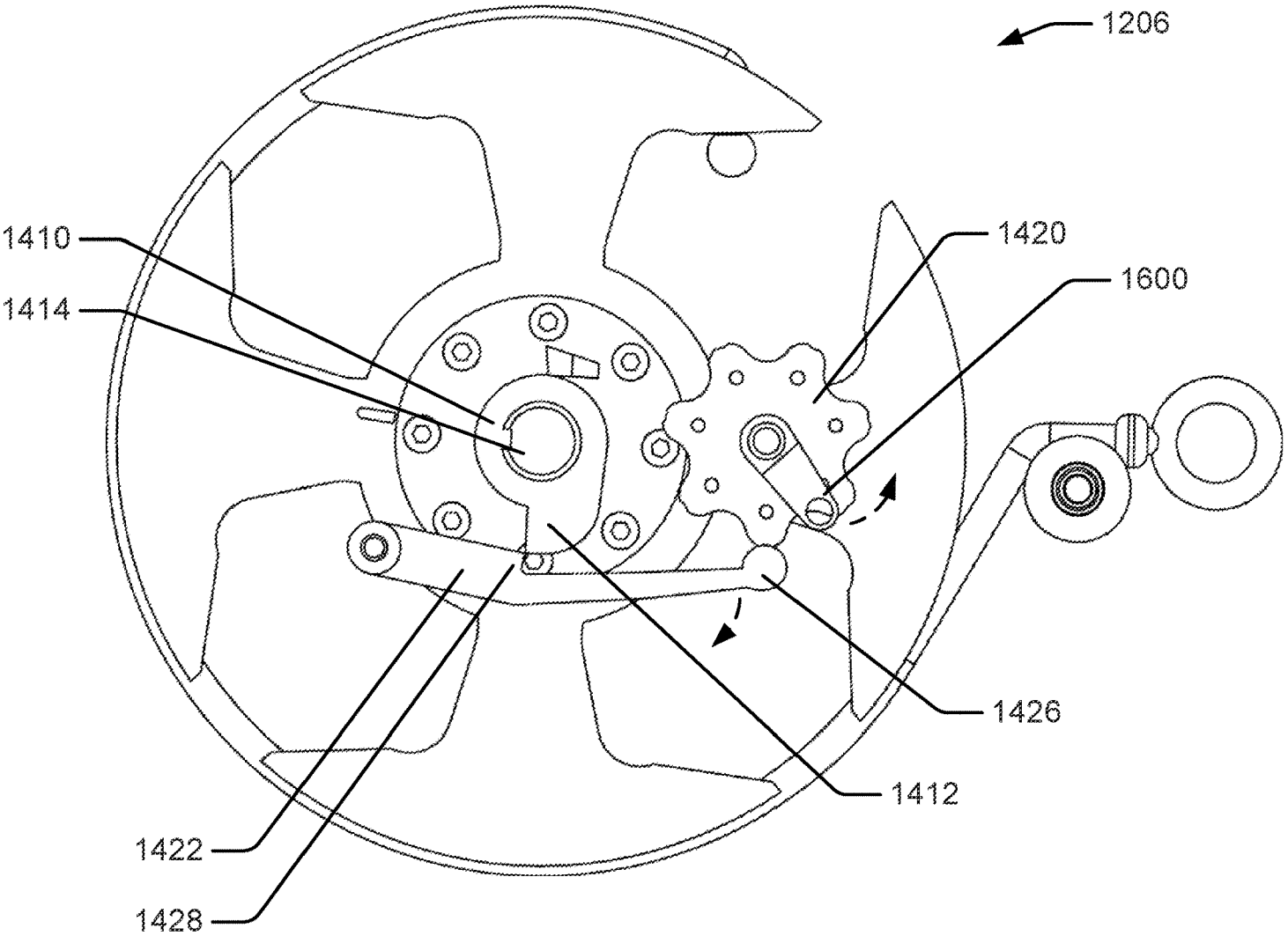

FIG. 16 shows loading mechanism 1206 after an auxiliary load has been applied, energy stored in auxiliary member 104, after an arrow (not shown) may have been nocked (loaded), and a draw string drawn to a release position similar to FIG. 4A. FIG. 16 shows arm 1600 that may be coupled to buss cables 122 and cause the rotation to the position shown in FIG. 16. Rotation of arm 1600 may cause toggle wheel 1420 to rotate causing locking arm 1422 to rotate by applying a force on end 1426. End 1426 of locking arm 1422 may be held in position by a peak along the perimeter of toggle wheel 1420. Additionally or alternatively, a localize valley or other such feature may exist on the peaks of the perimeter of toggle wheel 1420. This may provide a local stability point in holding locking arm 1422 is said position. From this position, the draw string may be released and may cause a projectile to fly.

Additionally or alternatively, with locking arm displaced as shown in FIG. 16, locking interface 1428 may be selectively disengaged from ratchet 1410. Ratchet 1410 and shaft 1414 are not shown to have rotated since, in various embodiments, the displaced limbs 112 (not shown) have further displace auxiliary members 104 and hold them in place.

Figure 17:
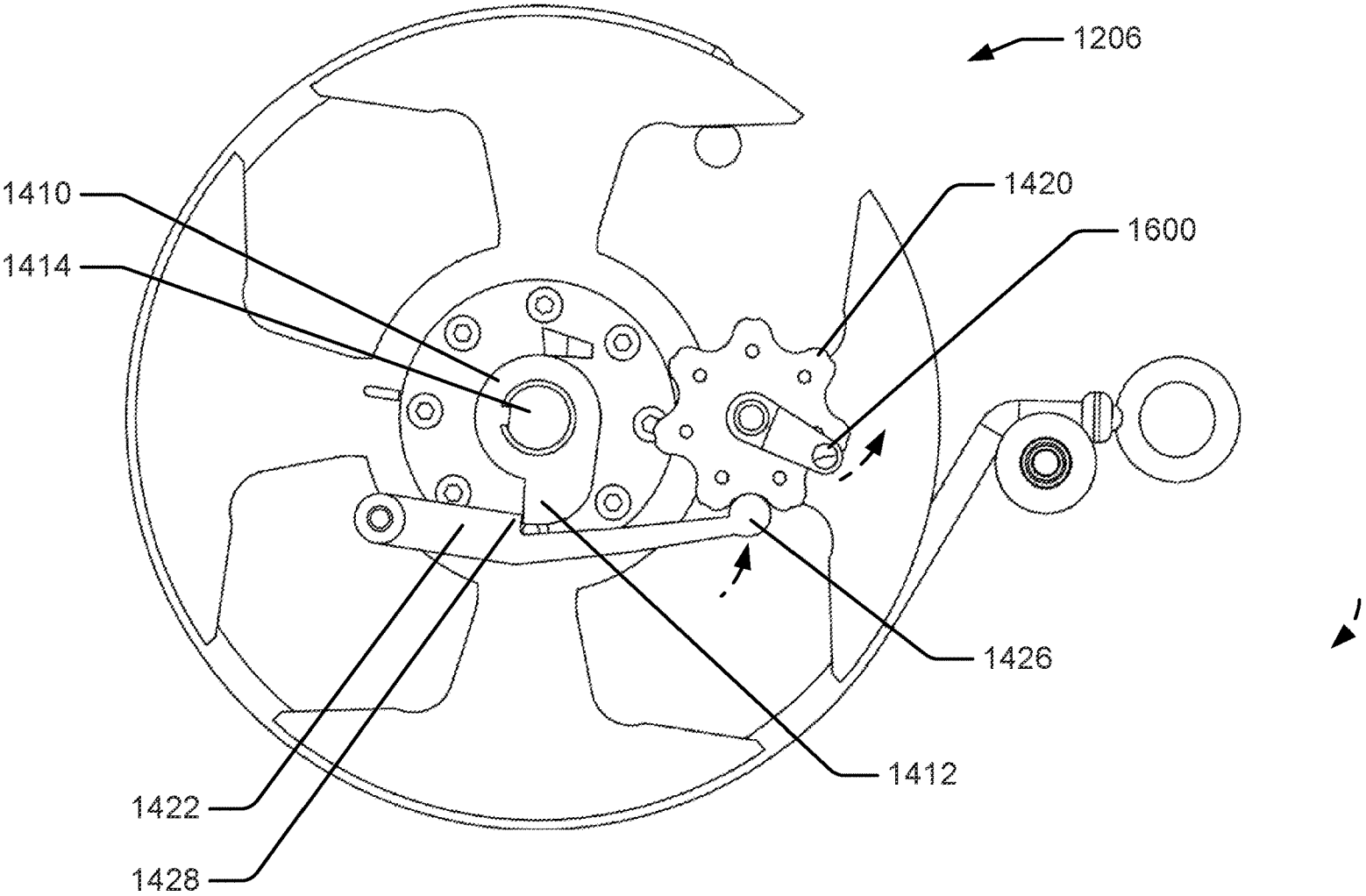

FIG. 17 shows loading mechanism 1206 after a draw string has been drawn from a release position to a return position similar to FIG. 5A. FIG. 17 shows arm 1600 rotate further due to further movement of buss cables 1222. This movement in turn causes toggle wheel 1420 to rotate allowing locking arm 1422 to engage locking interface 1428 with tooth 1412 of ratchet 1410. This configuration may allow for a draw string to be returned to an at rest position without a force from the auxiliary members 104 pushing on limbs 112.

Figure 18:
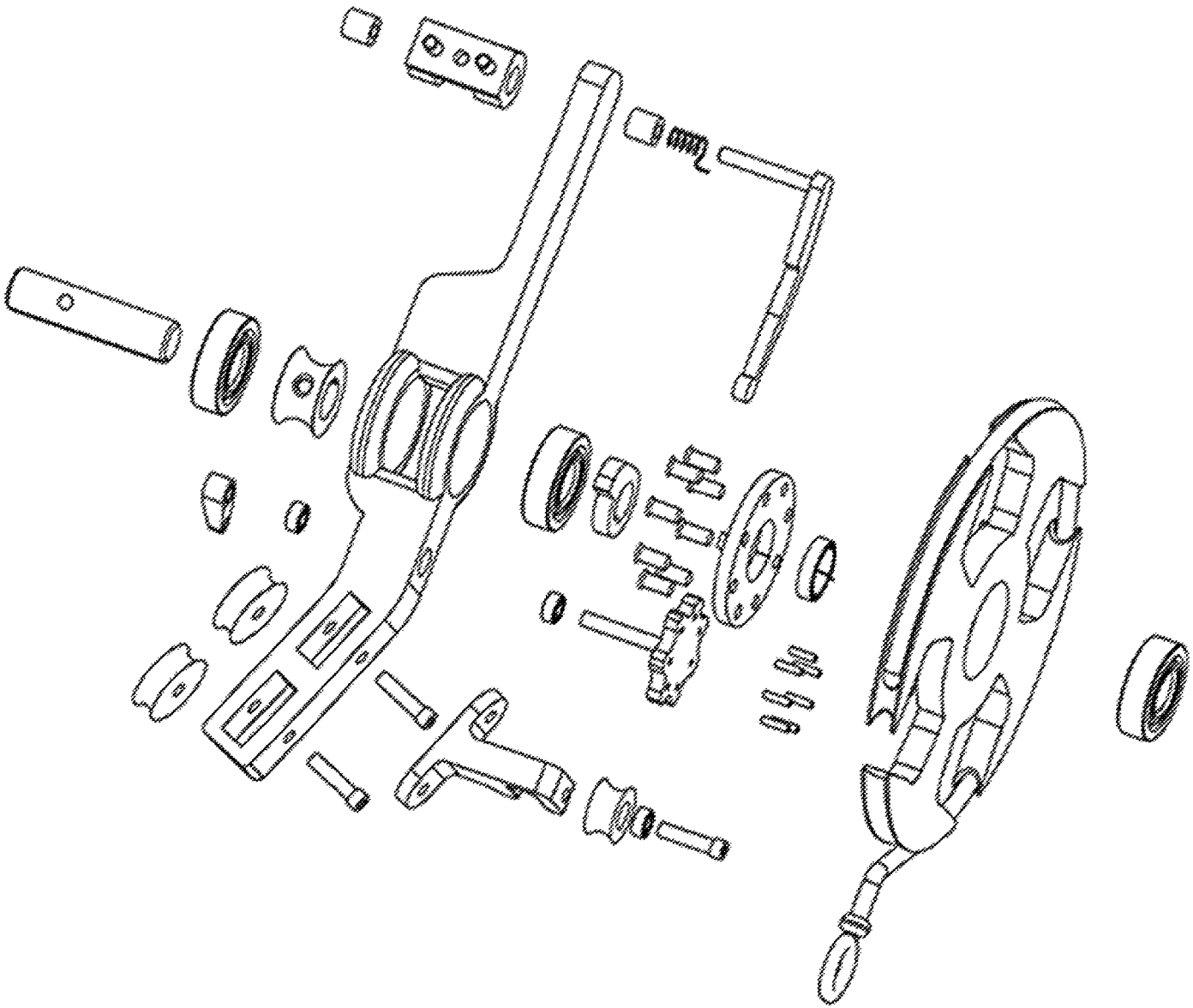
FIG. 18 depicts an exploded view of a portion of an additional illustrative power assist system of FIGS. 12A-C.

FIG. 18 shows an exploded view of loading mechanism 1206.

Additional Illustrative Bow with Power Assist System

Figure 19B:
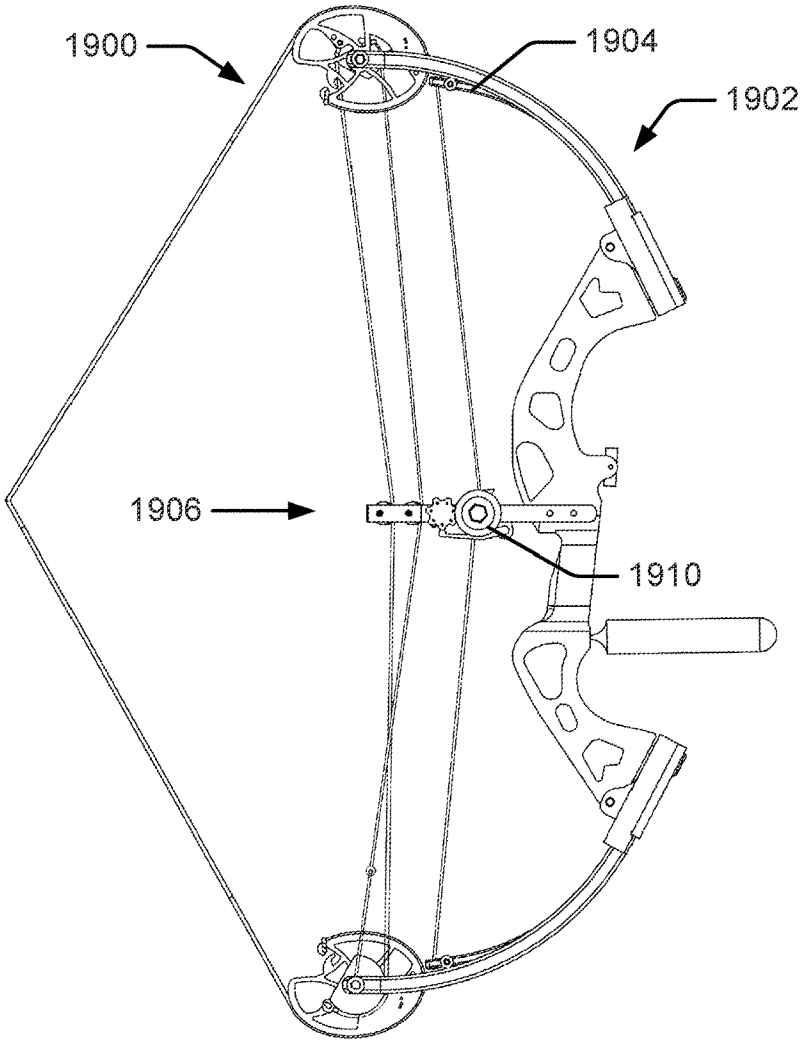
FIGS. 19A-B depict an additional illustrative compound bow with a power assist system.
Figure 19A:
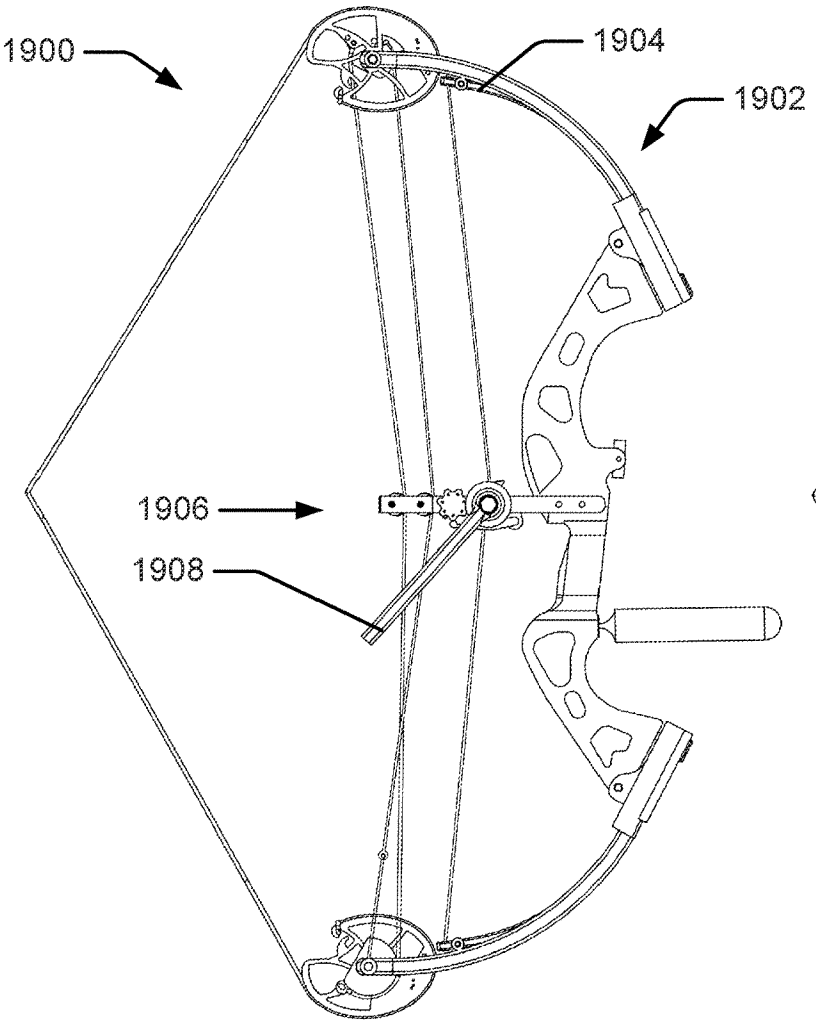

FIGS. 19A-B show an additional embodiment of an illustrative compound a bow 1900 with a power assist system 1902. Bow 1900 operates in the substantially the same way as bow 1200 in terms of operation. As such, discussion of those operating features may be reviewed above. Additionally or alternatively, portions of power assist system 1902 operate similar to power assist system 1202 discussed above. However, this embodiment contemplates that loading mechanism 1906 operates differently is some capacities from loading mechanism 1206.

For example, FIG. 19A shows loading mechanism 1906 similar to loading mechanism 1206 as discussed above. Various differences include that pull cable 1300 and pull cable wheel 1304 have been replaced by a power loading tool 1908 that may be removably coupled to a power loading head 1910.

Figures 20A, 20B, 20C:
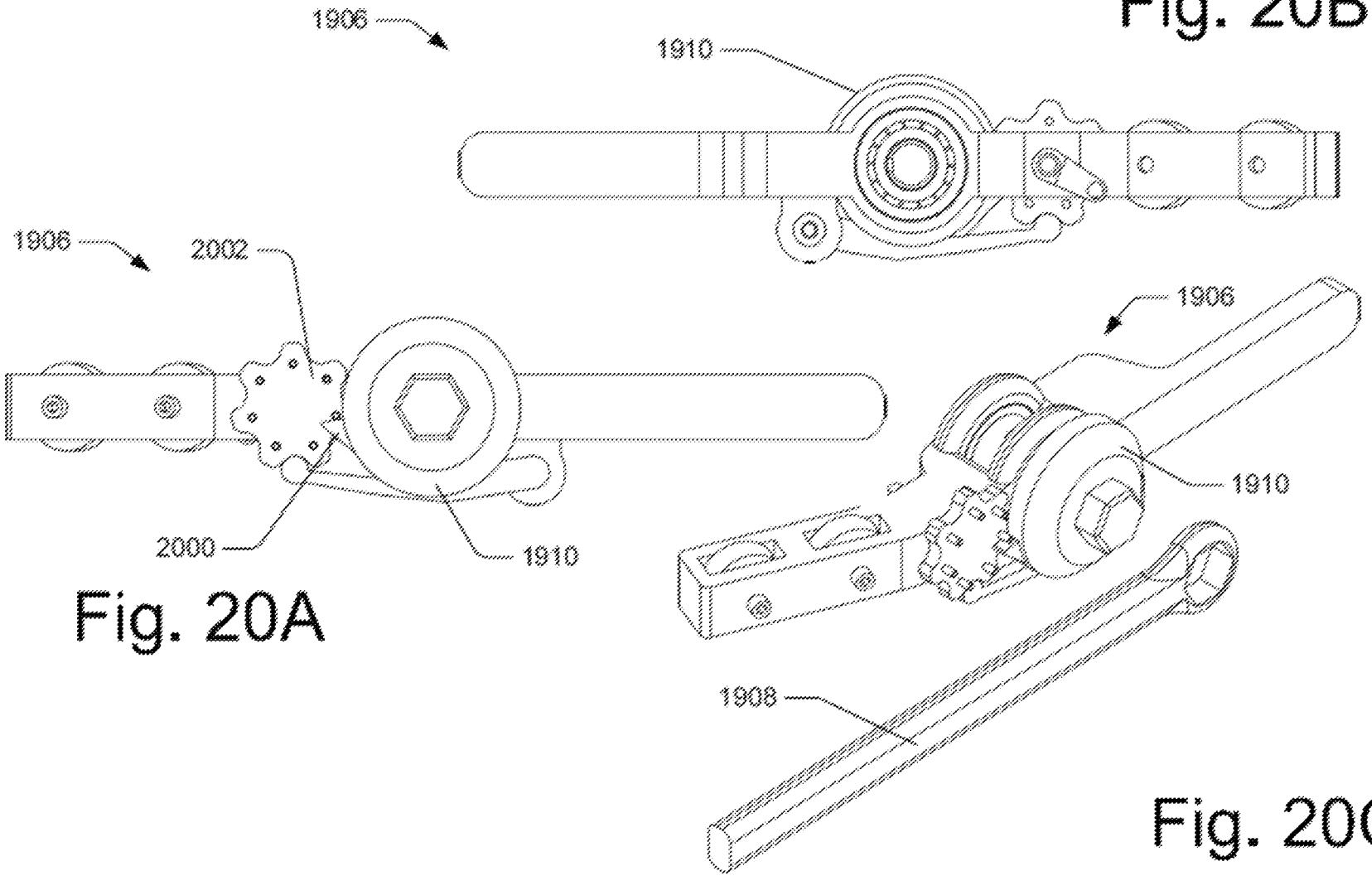
FIGS. 20A-C depict a portion of the illustrative power assist system of FIGS. 19A-B.

FIGS. 20A-C show various views of loading mechanism 1906. For example FIG. 20A shows a profile view of loading mechanism 1906 where power loading head 1910 may comprise a indexing protrusion 2000 that may engage a toggle wheel 2002 in a manner similar to that discussed above with respect to toggle wheel 1420. Rotation of power loading head 1910 may cause similar results as did pull cable wheel 1304 including causing a load to be placed on auxiliary limbs 104. Power loading head 1910 may be operatively engaged by power loading tool 1908. Power loading tool 1908 may act as a lever allowing a user, for example an archer, to apply sufficient torque to power loading head 1910 to displace and energize auxiliary members 104.

Figure 21C:
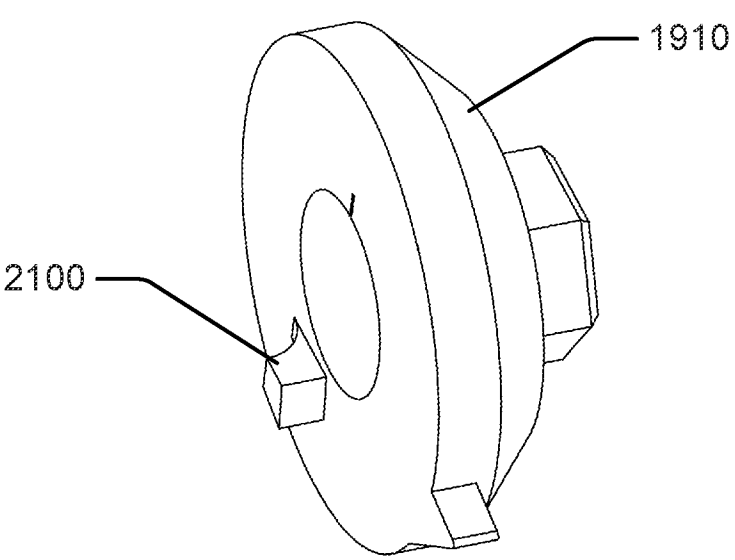
FIGS. 21A-C depict portions of the illustrative power assist system of FIGS. 19A-B.
Figure 21A:
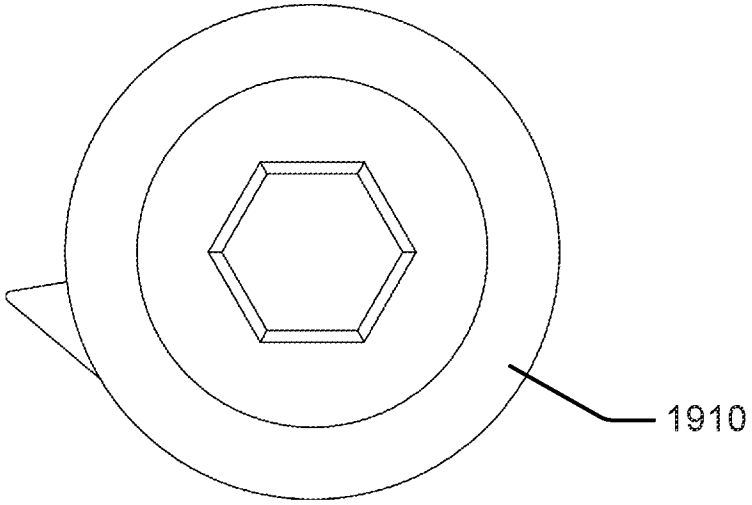
Figure 21B:
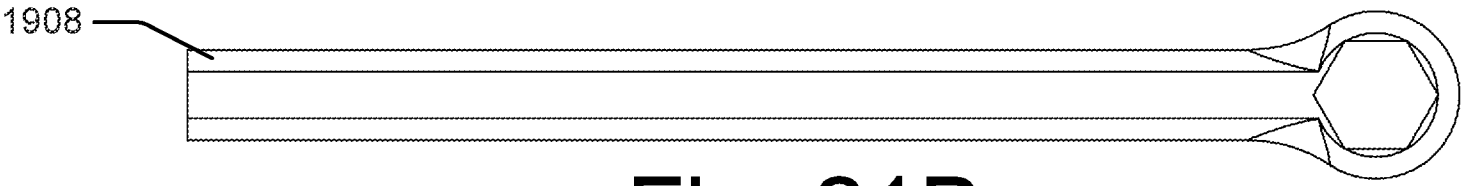

FIGS. 21A-C show additional views of power loading head 1910 and power loading tool 1908. For example, FIG. 21C shows a view of power loading head 1910 where power loading head 1910 may comprise a boss 2100 that may act in a fashion similar to boss 1408 as shown in FIG. 14.

Illustrative Methods

Figure 22:
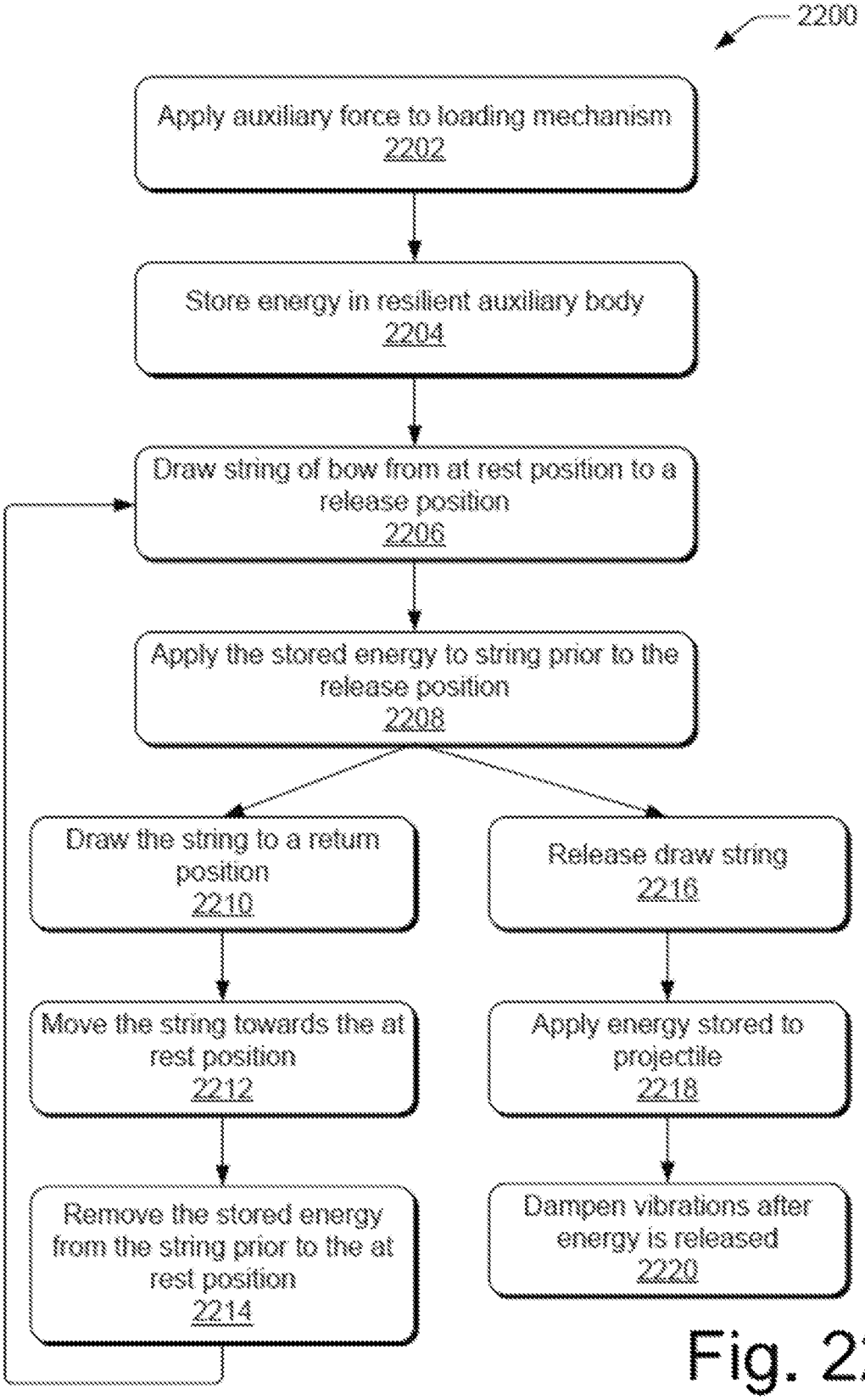
FIG. 22 depicts a flowchart illustrating operation of a compound bow with a power assist system.

FIG. 22 is a flowchart of one illustrative method 2200 of operating a bow with a power assist system as discussed above with respect to the various contemplated embodiments. For ease of understanding, the method 2200 is described in the context of the configuration shown in FIGS. 1A-8C. However, the method 2200 is not limited to performance using such a configuration and may be applicable to other bows and other types of power assist systems.

In this particular implementation, the method 2200 begins at block 2202 in which an auxiliary force is applied to a loading mechanism, for example, loading mechanism 106. At block 2204, energy is stored in a resilient auxiliary body, for example, auxiliary member 104.

At block 2206, a draw string of the bow may be drawn from an at rest position towards a release position. It is contemplated that an arrow may be nocked in anticipation of shooting the arrow.

At block 2208, the stored energy from block 2204 is applied to the draw string prior to the draw string reaching the release position. For example, limbs 112 may be displaced such that they engage auxiliary members 104 and exert a force sufficient to hold the auxiliary members 104 in an energized position. Additionally or alternatively, various embodiments contemplate that a locking mechanism may be disengaged prior to the draw string reaching the release position, but after the limbs 112 engage auxiliary members 104.

Additionally or alternatively, various embodiments contemplate that the limbs 112 may begin to engage auxiliary members 104 as the force on the draw string begins to let off. For example, as the let off would normally reduce the load by a force amount per unit drawn, the engagement of the auxiliary members 104 would cause a similar amount of force per unit drawn to be added to the draw string. The added amount may be at a higher or lower ratio than the let off would normally provide. Various embodiments contemplate that the let off and the additional force added by the auxiliary members may provide for a smooth transition such that a user may not notice the change or change over.

Additionally or alternatively, a projectile, if loaded may be released and propelled by the stored energy in the limbs 112 and auxiliary members 104.

At block 2210, the draw string may be drawn to a return position, for example, position 500. Various embodiments contemplate that a locking mechanism may be engaged.

At block 2212, the draw string may be moved towards the at rest position.

At block 2214, the stored energy in the auxiliary members 104 may be removed prior to the draw string reaching the at rest position. Various embodiments contemplate that the force from the auxiliary members 104 may be removed as the draw string passes through the let off position. When the draw string reaches the at rest position, a user may draw the bow and return to block 2206.

At block 2216, the draw string may be released and the energy stored in both the limbs 112 and the auxiliary members 104 may be transferred to a projectile at block 2218.

At block 2220, the auxiliary members may provide dampening to the bow after the energy has been released.

Illustrative Bow with Power Assist System

Figure 23B:
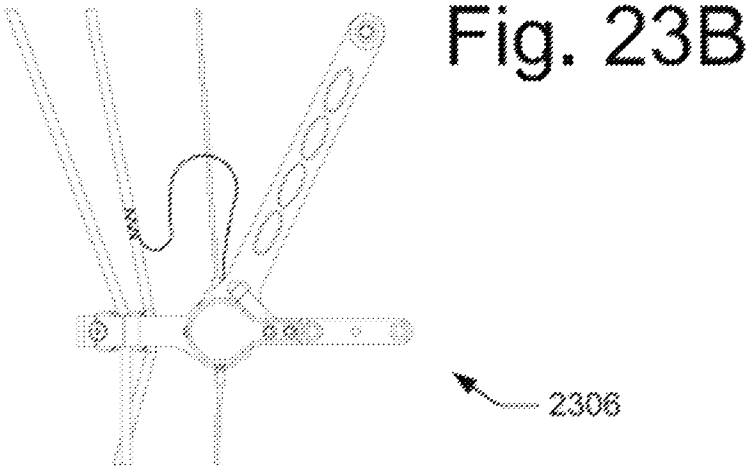
FIGS. 23A-C depict an illustrative compound bow with a power assist system.
Figure 23C:
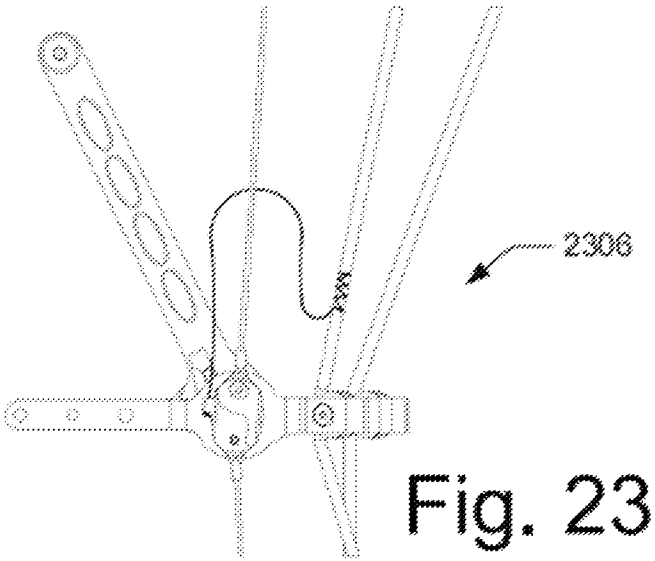
Figure 23A:
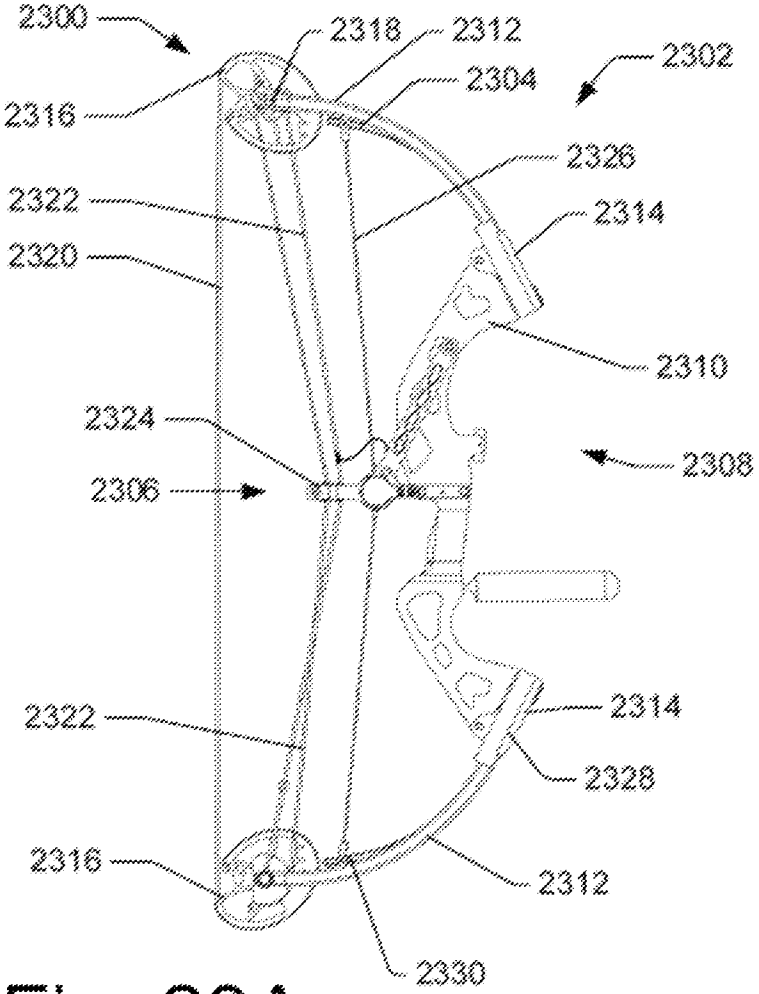

FIG. 23A depicts an illustrative compound bow 2300 with a power assist system 2302. In one embodiment, the power assist system 2302 may include a resilient auxiliary member 2304 and a loading mechanism 2306. The compound bow 2300 may include a central body or central mount region 2308, which may include a riser 2310, where bow components may be mounted including, but not limited to, limbs, sights, stabilizers, and quivers. FIG. 23A also shows limbs 2312 of the bow coupled to the riser 2310 at mount location 2314. The limbs 2312 may comprise a solid limb and/or a split limb configuration. Often the limbs 2312 mounting may be adjusted at the mount location 2314. Often attached to the limbs are cams, wheels, or a combination thereof. For example, different bows may have different bow eccentricities including, but not limited to, single cam, hybrid cam, dual cam, binary cam, quad cam, and hinged. For example, FIG. 23A shows an example of a dual cam where a cam 2316 is coupled to limb 2312 at mount location 2318. Cam 2316 may take various forms that may influence a force draw profile of the bow. The bow may often have at least two cams 2316 that may be connected through various means including, but not limited to, strings, cables, lines, wires, or the like. For example, bow 2300 may include a draw string 2320 that may be drawn or pulled to various positions. Additionally, a projectile including an arrow (not shown) may be nocked to the string 2320. The cams 2316 may also be coupled by buss cables 2322. The buss cables 2322 may be attached to the cams 2316 and/or at or near the mount location 2318. The buss cables may also be displace laterally from the center of the bow 2300 by a buss cable bar and/or guide 2324.

When the draw string 2320 is moved from an at rest position as shown in FIG. 23A, the draw string 2320 may cause the cams 2316 to rotate that may cause buss cables 2322 to wrap around a portion of the cams 2316 placing an additional tension force on draw string 2320 and buss cables 2322. This additional tension force may cause limbs 2312 to bend and where mount locations 2318 may move closer to each other while mount positions 2314 may remain relatively fixed. The bending of limb 2312 may store the potential energy used to accelerate a projectile as is understood by one of ordinary skill in the art. As the draw string 2320 is drawn back towards an arrow release position (not shown) and the cams 2316 continue to rotate, the cam 2316 shape provides a mechanical advantage where the force required to draw the draw string 2320 back may be reduced or "let off" as the draw string 2320 reaches the release position.

Bow 2300 may be constructed using various materials. For example, riser 2310 may be aluminum, aluminum alloy, magnesium alloy, composites, or a combination thereof. The limbs 2312 may be made from various resilient materials including, but not limited to, composite materials. Often the limbs may be designed with various composite materials to be capable of taking high tensile and compressive forces in various configurations. Draw string 2320 and buss cables 2322 may comprise high-modulus polyethylene, polyester, natural materials, plastic-coated steel, among others, and designed to have great tensile strength and minimal stretchability.

FIG. 23A also shows an illustrative embodiment of a power assist system 2302 comprising a resilient auxiliary member 2304 and a loading mechanism 2306. The loading mechanism may be coupled to the auxiliary member 2304 through a connector, for example, load cable 2326. It is understood that the connector may comprise a member with a high tensile strength and low buckling strength such as a string, cable, wire, or the connector may comprise a member with a high tensile strength and a high buckling strength such as a ridged link comprised of a metallic or composite material. It is contemplated that materials and properties used in the buss cables as discussed above may be utilized for load cable 2326.

Further, auxiliary member 2304 may comprise an auxiliary limb configuration where auxiliary member 2304 may be fixably coupled at a first end 2328 at mount location 2314 and displacably coupled to the loading mechanism 2306 at a second end 2330. Various embodiments contemplate that auxiliary member 2304 may be disposed between two limbs 2312 of a split limb configuration of bow 2300. Various embodiments contemplate that auxiliary member 2304 may comprise various resilient materials including, but not limited to, composite materials. Various embodiments contemplate that auxiliary member 2304 may be designed with various composite materials to be capable of taking high tensile and compressive forces in various configurations. This may allow auxiliary member 2304 to store and transfer or expel energy depending on the relative positions of first end 2328 and second end 2330. For example, if auxiliary member 2304 is bent from a rest position, auxiliary member 2304 may store an amount of energy. If auxiliary member 2304 returns to a rest position, the stored amount of energy may be transferred or expelled.

FIG. 23A also shows an illustrative embodiment of loading mechanism 2306 coupled to auxiliary member 2304 through load cable 2326. In this embodiment, loading mechanism 2306 is located between a distal pair of auxiliary members 2304 and as well as between a distal pair of limbs 2312 and coupled to riser 2310. FIGS. 23B-C show a portion of loading mechanism 2306 from opposite sides. For example, FIG. 23B shows a portion of loading mechanism 2306 from the same side as shown in FIG. 23A while FIG. 23C shows the same portion of loading mechanism 2306 from the opposite side. FIGS. 23A-C show the respective portions of loading mechanism 2306 at an at rest position without an auxiliary load applied.

Figure 24A:
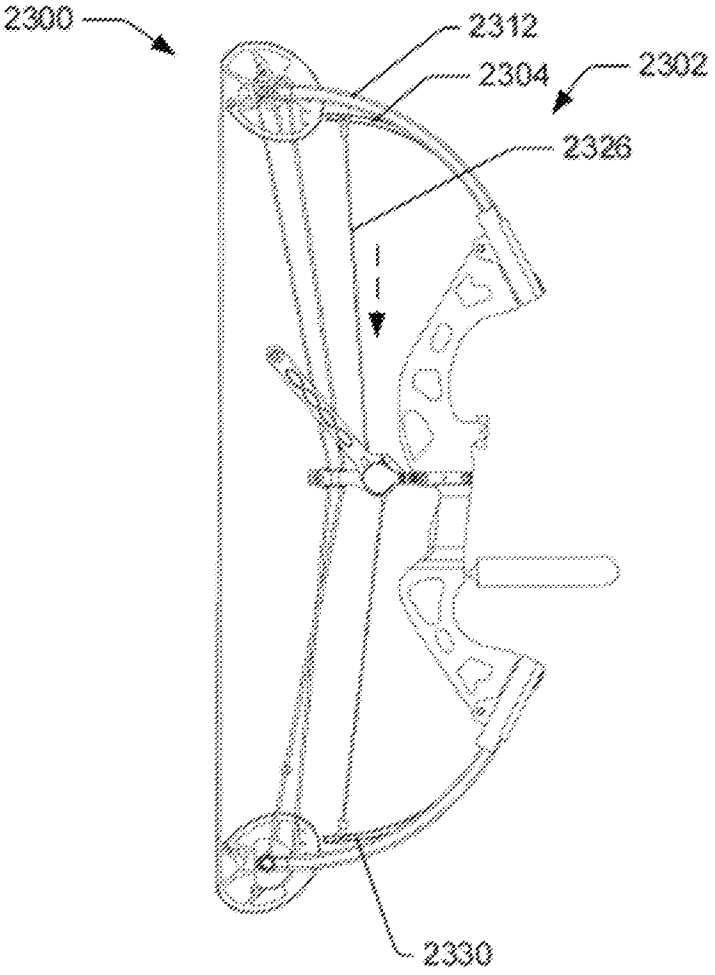
FIGS. 24A-31B depict the illustrative compound bow with a power assist system of FIGS. 23A-C in various positions.
Figure 24B:
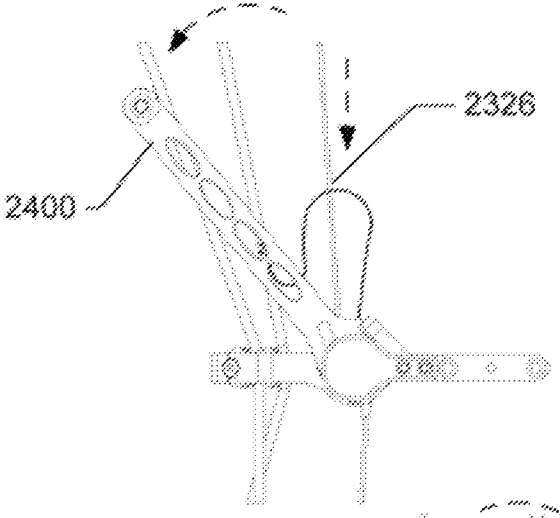
Figure 24C:
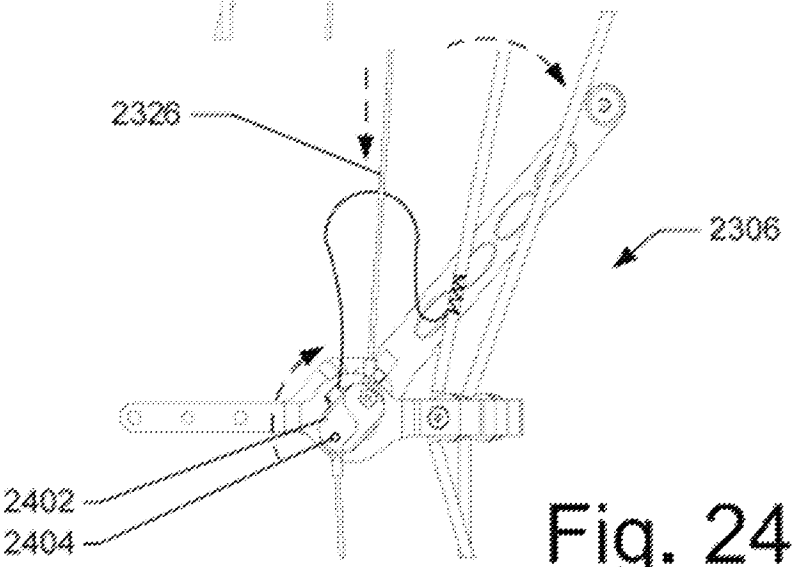

FIGS. 24A-C show the illustrative embodiment of FIG. 23A as an auxiliary load is being applied and energy beginning to be stored in auxiliary member 2304. The dotted arrows indicate various relative movement of various components from the state shown in FIGS. 23A-C to reach the state shown in FIGS. 24A-C. Various embodiments contemplate that loading mechanism 2306 may comprise a power loading lever 2400. It is contemplated that power loading lever 2400 may comprise any suitable device or configuration including, but not limited to, materials including metallics, composites, wood, or combinations thereof. Power loading lever 2400 may also comprise a wheel configuration, or portions thereof, a geared system, or other configurations that allow a user a mechanical advantage in loading the auxiliary members 2304. Various embodiments contemplate that power loading lever 2400 may be rotated to a second position to load the auxiliary members 2304. Various embodiments contemplate that the power loading lever 2400 may be rotated approximately 180 degrees. Various embodiments contemplate that the power loading lever 2400 may be rotated slightly more than 180 to load the auxiliary members 2304. Additionally or alternatively, various embodiments contemplate that the power loading lever 2400 may be rotated substantially less than 180 degrees to load the auxiliary members 2304. For example, the tension in the load cables 2326 and relative position of the power loading lever 2400 may be adjusted.

It is also contemplated that the power loading lever 2400 may be coupled to a camshaft 2402. Various embodiments contemplate that power loading lever 2400 may comprise a boss or other protrusion, that may selectively engage a ratchet comprising at least one tooth, where the ratchet may be coupled to the camshaft 2402. Various embodiments contemplate that the camshaft 2402 may be coupled to the load cables 2326. Additionally or alternatively, various embodiments contemplate that the load cables 2326 may be fixedly attached to an attachment location 2404 on the camshaft 2402 that may be offset from a rotational axis of the camshaft 2402. The attachment location 2404 may allow the load cables 2326 to rotate and/or pivot. Various embodiments contemplate that a rotation of the camshaft 2402 may cause the attachment location 2404 to move relative to the limb 2412. Various embodiments contemplate that the rotation of camshaft 2402 may cause load cables 2326 apply a force to auxiliary members 2304 causing auxiliary members 2304 to displace from an initial position.

This displacement may cause a tension and or an additional tension load on load cables 2326. This tension and displacement may cause a displacement of the second end 2330 of auxiliary member 2304. This displacement may cause energy to be stored in the auxiliary member 2304. It is noted that this may cause the second end 2330 of the auxiliary member 2304 to move away from limb 2312. Various embodiments contemplate that the displacement of the second end 2330 be congruent and/or consistent with the displacement of the limbs 2312 as per a design of the bow 2300. This may range from greater than zero inches to less than five inches. Additionally or alternatively, various embodiments contemplate a displacement between one and two inches.

Figure 25B:
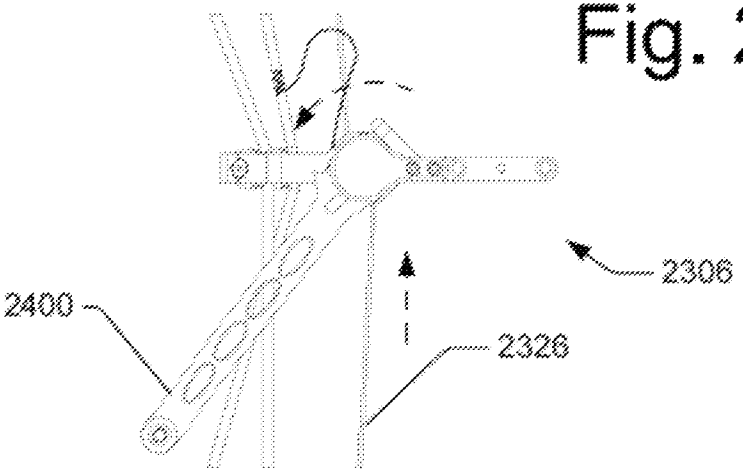
Figure 25C:
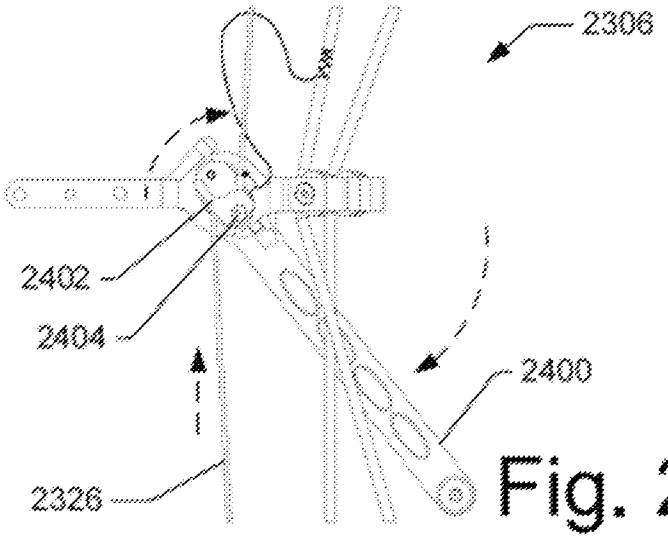
Figure 25A:
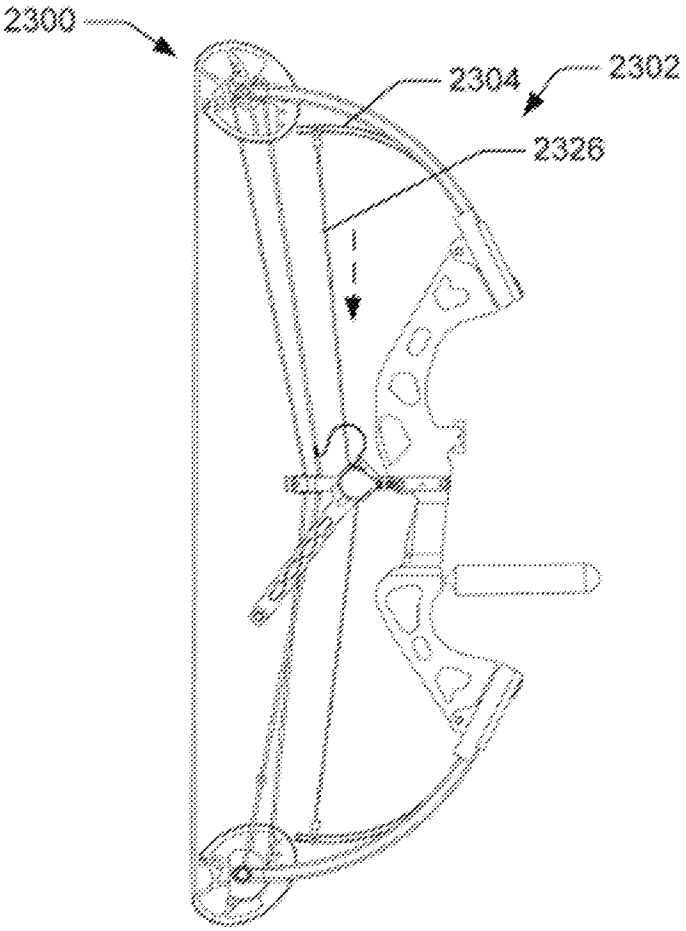

FIGS. 25A-C show the illustrative embodiment of FIG. 23A as an auxiliary load is being applied and energy beginning to be stored in auxiliary members 2304. The dotted arrows indicate various relative movement of various components from the state shown in FIGS. 24A-C to reach the state shown in FIGS. 25A-C. For example, FIGS. 25A-C show power loading lever 2400 continuing to rotate further displacing auxiliary members 2304.

Figure 26B:
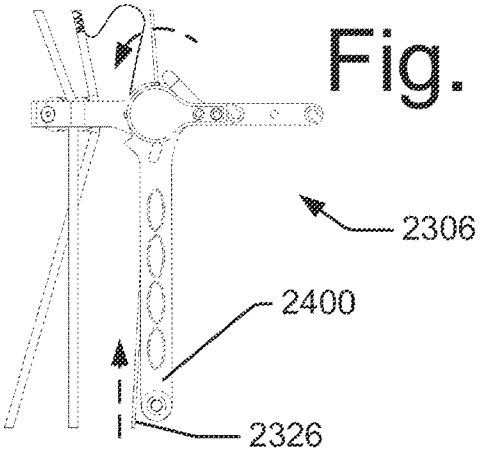
Figure 26C:
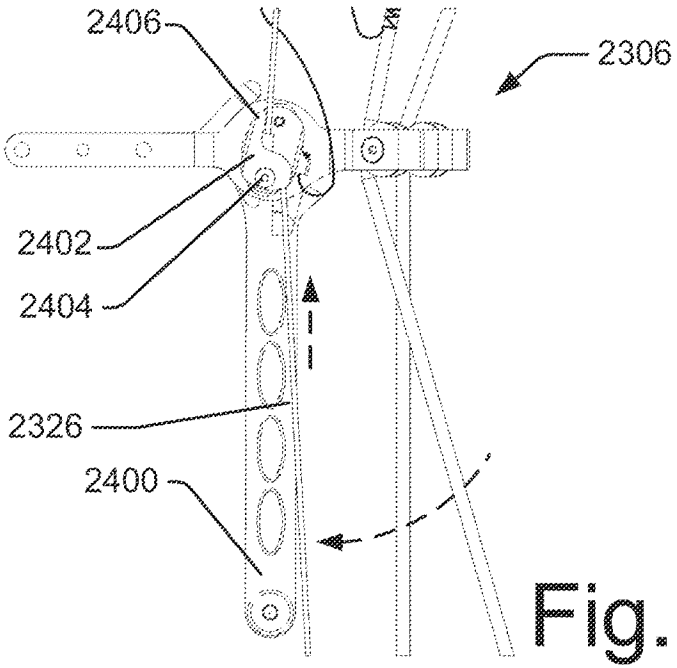
Figure 26A:
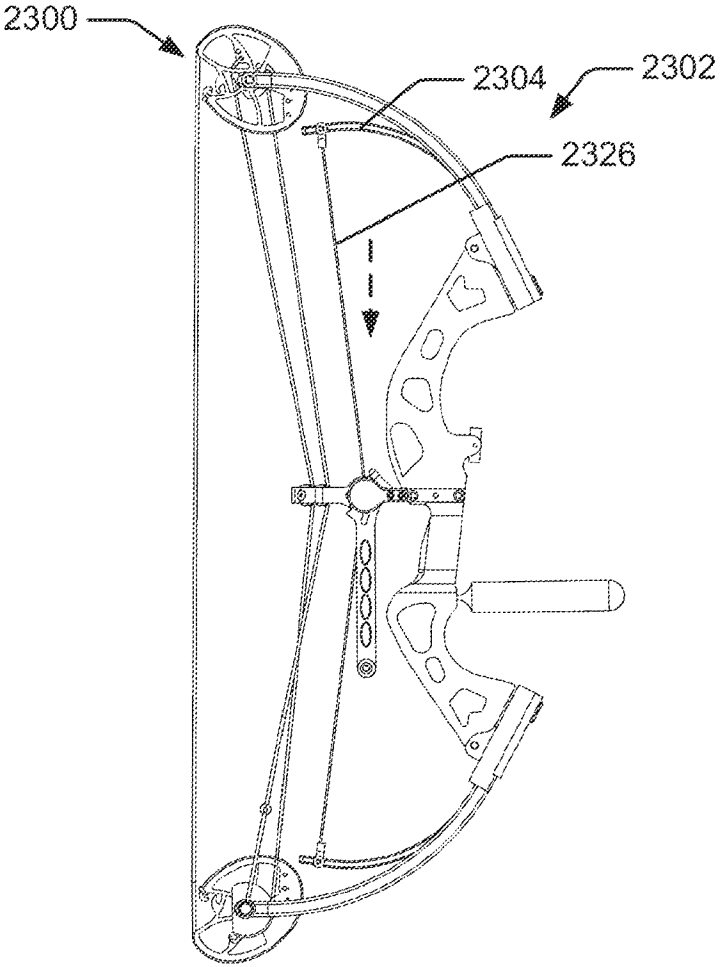

FIGS. 26A-C show the illustrative embodiment of FIG. 23A as an auxiliary load is applied and energy is stored in auxiliary members 2304. The dotted arrows indicate various relative movement of various components from the state shown in FIGS. 25A-C to reach the state shown in FIGS. 26A-C. For example, FIGS. 26A-C show power loading lever 2400 rotated displacing auxiliary members 2304. FIGS. 26A-C show that camshaft 2402 has rotated such that the load cables 2326 attached to the attachment locations 2404 move past the camshaft axis. Tension in the load cables 2326 exerted by the auxiliary members 2304 may keep camshaft 2402 from reversing its rotation. Additionally or alternatively, the camshaft 2402 may be configured to engage the load cables 2326 or connections of the load cables 2326 to stop camshaft 2402 from rotating further in the direction of the tension in the load cables 2326. Specifically, camshaft 2402 may comprise one or more protrusions 2406 configured to contact the load cables 2326. Various embodiments contemplate that this configuration may comprise a loaded and locked configuration.

Figure 27A:
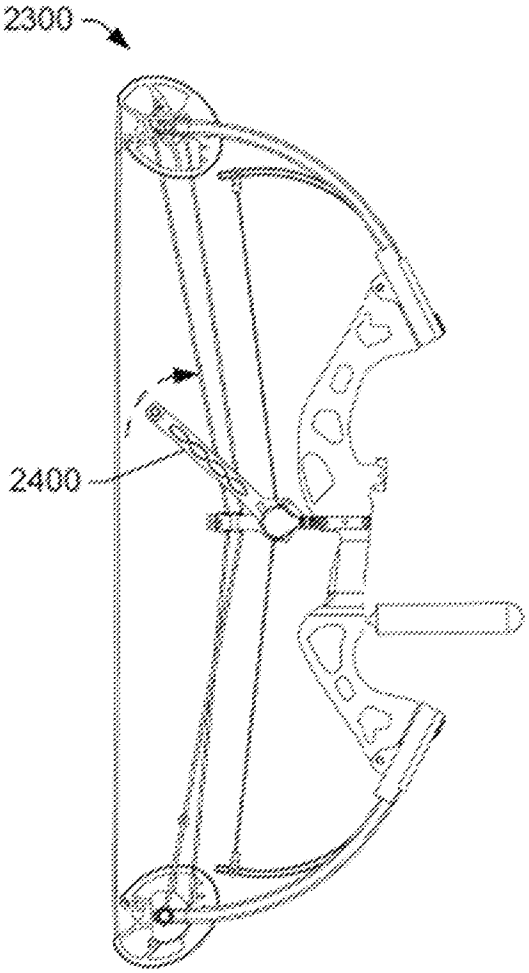
Figure 27B:
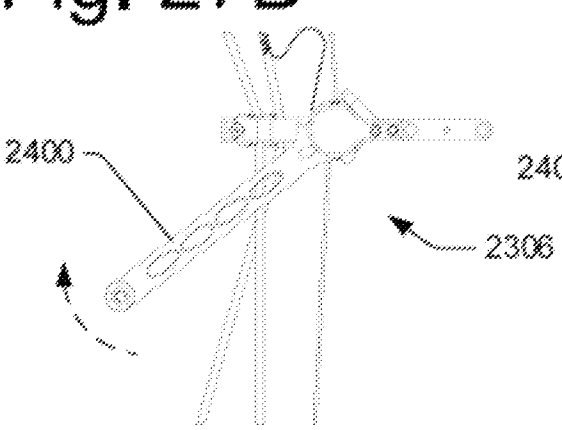
Figure 27C:
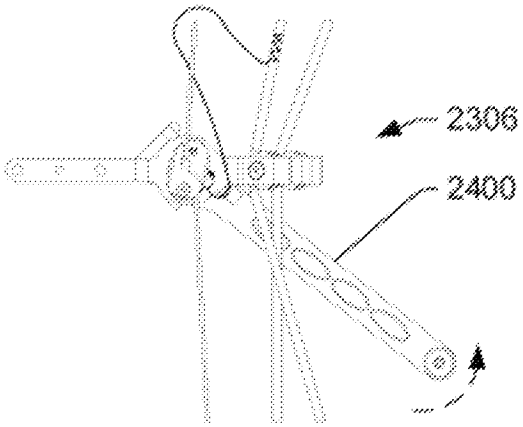
Figure 27D:
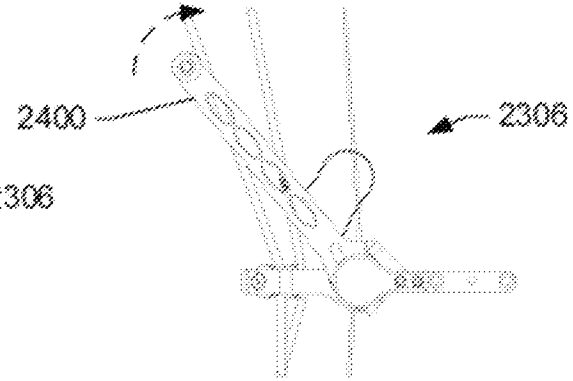
Figure 27E:
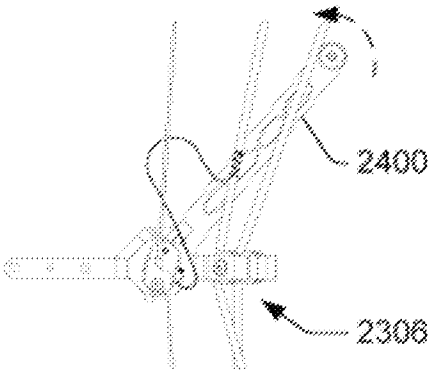

FIGS. 27A-E show the illustrative embodiment of FIG. 23A as energy is stored in auxiliary members 2304. The dotted arrows indicate various relative movement of various components from the state shown in FIGS. 26A-C to reach the state shown in FIGS. 27A-E. For example, FIGS. 27B-C show power loading lever 2400 being rotated to return towards the initial position. FIGS. 27A, D, and E show power loading lever 2400 rotated further towards the initial position.

Figure 28B:
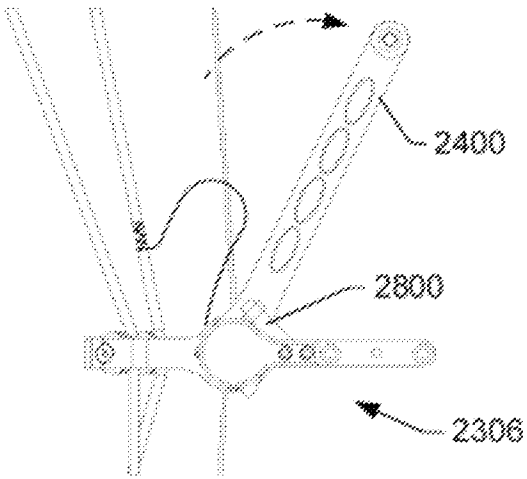
Figure 28C:
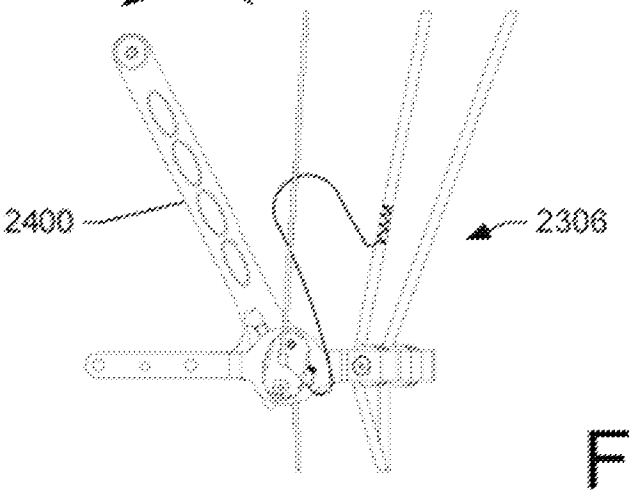
Figure 28A:
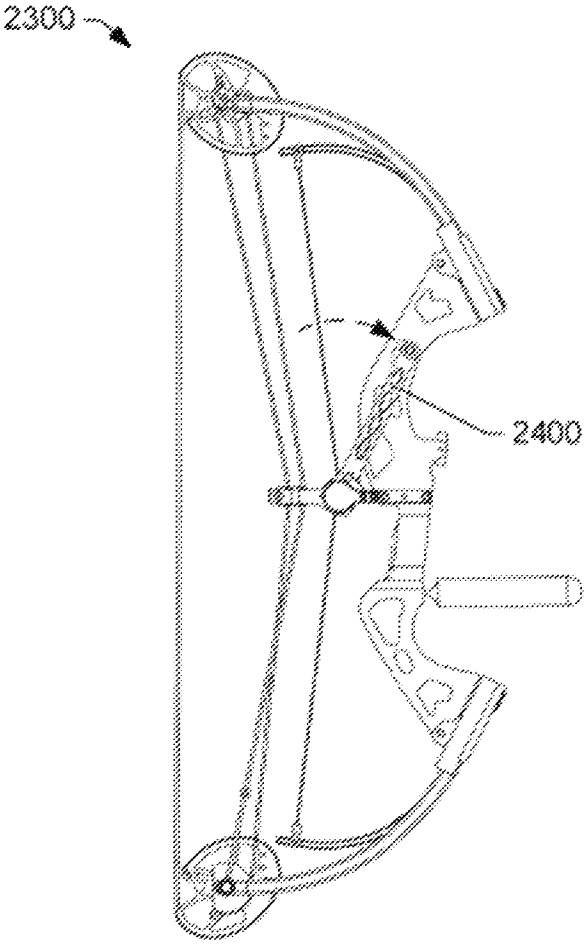

FIGS. 28A-C show the illustrative embodiment of FIG. 23A as energy is stored in auxiliary members 2304. The dotted arrows indicate various relative movement of various components from the state shown in FIGS. 27A-E to reach the state shown in FIGS. 28A-C. For example, FIGS. 28A-C show power loading lever 2400 rotated and returned to the initial position. Various embodiments contemplate that the power loading lever 2400 may be secured or stowed, for example, by engaging a clip 2800, a biasing spring, or a combination thereof. Additionally or alternatively, various embodiments contemplate that the power loading lever 2400 may be detachable.

Figure 29B:
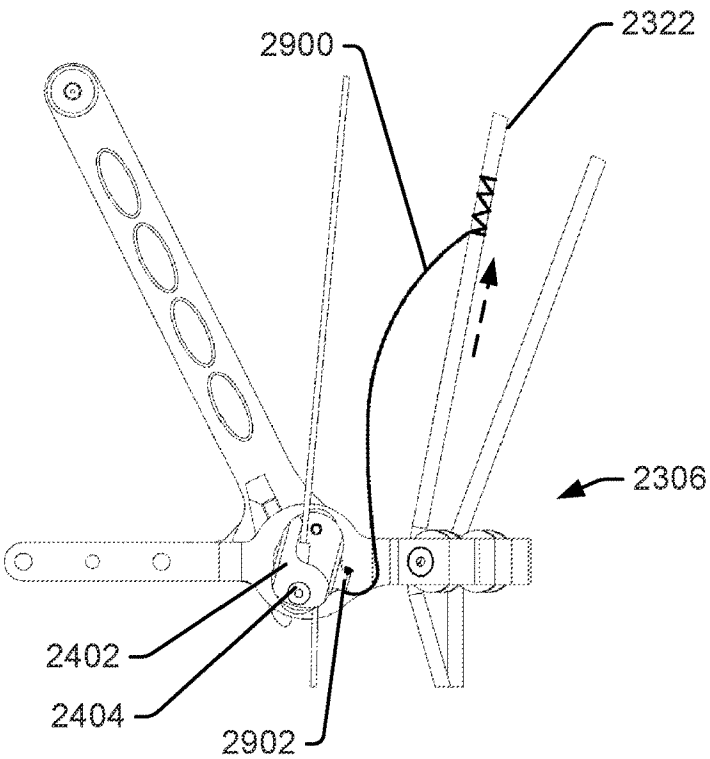
Figure 29A:
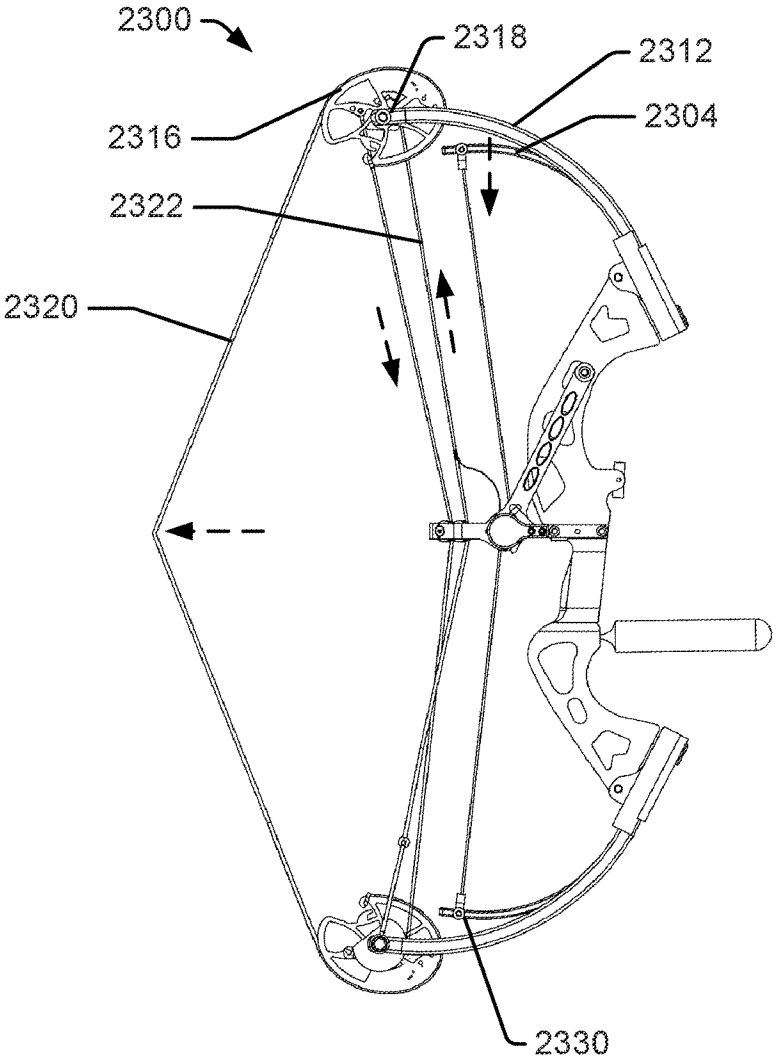

FIGS. 29A-B show the illustrative embodiment of FIG. 23A after an arrow (not shown) may have been nocked (loaded) and the draw string 2320 drawn towards a release position. For example, FIG. 29A shows that displacement of draw string 2320 may cause cams 2316 to rotate causing the buss cables 2322 to wrap around a portion of the cams 2316 placing an additional tension force on draw string 2320 and buss cables 2322. This additional tension force may cause limbs 2312 to bend and where mount locations 2318 may move closer to each other. The bending of limb 2312 may store the potential energy used to accelerate a projectile as is understood by one of ordinary skill in the art. As the draw string 2320 is drawn back towards an arrow release position (not shown) and the cams 2316 continue to rotate, the cam 2316 shape provides a mechanical advantage where the force required to draw the draw string 2320 back may be reduced or "let off" as the draw string 2320 reaches the release position. This let off may be characterized as a percentage of the load placed on the limbs 2312. This percentage may vary between 0% and 100%. However, it is common for a compound bow to have a let-off percentage of between 50-90%.

Additionally or alternatively, various embodiments contemplate that trip or unlock cable or tether 2900 may be coupled to the camshaft 2402 at a location 2902 offset from the camshaft rotational axis. Various embodiment contemplate that the tether 2900 may be coupled to the buss cable 2322.

Figure 30B:
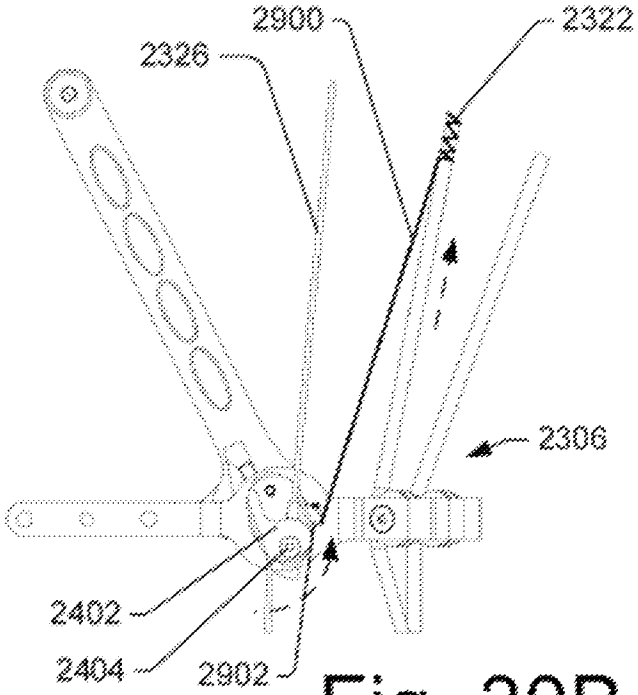
Figure 30A:
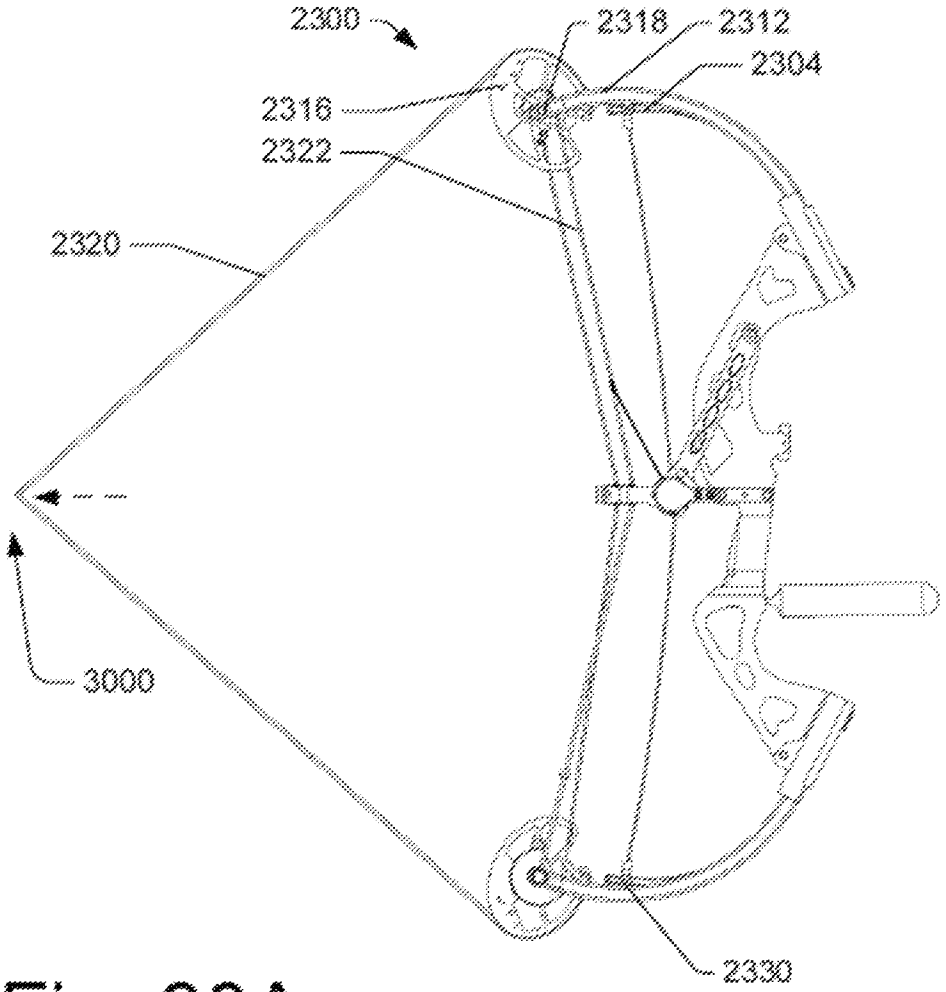

FIGS. 30A-B show the illustrative embodiment of FIG. 23A drawn to a release position 3000. For example, FIG. 30A shows that displacement of draw string 2320 may cause cams 2316 to further rotate causing the buss cables 2322 to wrap around a portion of the cams 2316 placing an additional tension force on draw string 2320 and buss cables 2322. Additionally or alternatively, as the cams 2316 rotate and cause limbs 2312 to displace, the limbs 2312 may engage auxiliary member 2304. For example, the limb 2312 may begin to be displaced as discussed above. At a point prior to draw string 2320 reaching release position 3000, the displacement of limb 2312 may be sufficient to engage the second end 2330 of auxiliary member 2304. As such, when the draw string 2320 reaches the release position 3000, the limbs 2312 keep auxiliary member 2304 displaced and release some or all of the tension in load cables 2326. Also prior to the draw string 2320 reaching the release position 3000, cams 2316 may have rotated sufficiently such that the force required to continue to move draw string 2320 toward release position 3000 is sufficiently reduced as part of the "let off" of the bow. Various embodiments contemplating that the bow being drawn enters the let-off region prior to engaging auxiliary member 2304. In these embodiments, the let off percentage may be applied to the combined load of the limbs 2312 and auxiliary member 2304. As such, a user, for example an archer, may advantageously position and hold a force on bow 2300 at a release position 3000 much greater than the user may have been able to without the power assist system 2302.

Additionally or alternatively, as the cams 2316 rotate causing the buss cables 2322 to displace as the draw string 2320 is drawn to the release position 3000, buss cable 2322 may be sufficiently displaced such that the tether 2900 may cause a rotation of camshaft 2402. Various embodiments contemplate that the rotation of camshaft 2402 may be sufficient to rotate load cable 2326 and/or the attachment location 2404 past the camshaft rotational axis. Various embodiments contemplate that this configuration may comprise a loaded and unlocked configuration. This may allow the full amount of energy stored in the auxiliary members 2304 to be transferred to limbs 2312 when the draw string 2320 is released from the release position to, for example, fire an arrow.

Various embodiments contemplate that the power assist system 2302 may unlock when the limb 2312 comes into contact with the auxiliary member 2304. Additionally or alternatively, various embodiments contemplate that the power assist system 2302 may unlock prior to the limb 2312 coming into contact with auxiliary member 2304. Additionally or alternatively, various embodiments contemplate that the power assist system 2302 may unlock after limb 2312 comes into contact with auxiliary member 2304. Various embodiments contemplate that limb 2312 may slightly compress auxiliary member 2304 beyond the loaded position. In this embodiment, load cables 2326 may have a reduction in tension. Various embodiments contemplate that the reduced tension may allow a lower tripping force to be applied though tether 2900. Various embodiments contemplate that the reduced tension may allow for a smoother transfer of force from the load cables 2326 to the limbs 2312. Various embodiments contemplate that the auxiliary members 2304 may engage limbs 2312 and transfer the pre-charged energy, via a normal force. Various embodiments contemplate that the engagement may comprise wheels, rollers, pads, direct contact, and/or combinations thereof.

Figure 31B:
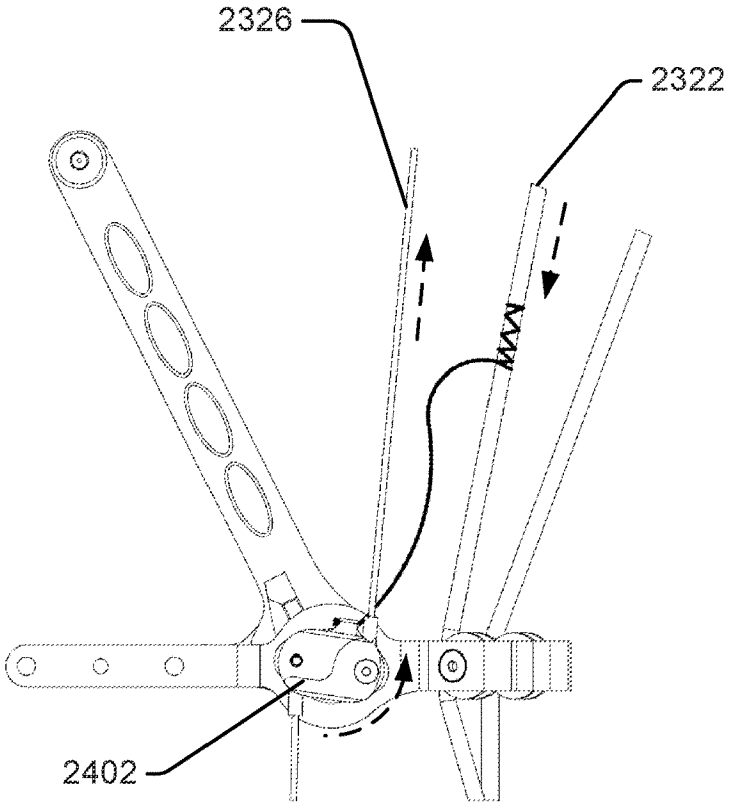
Figure 31A:
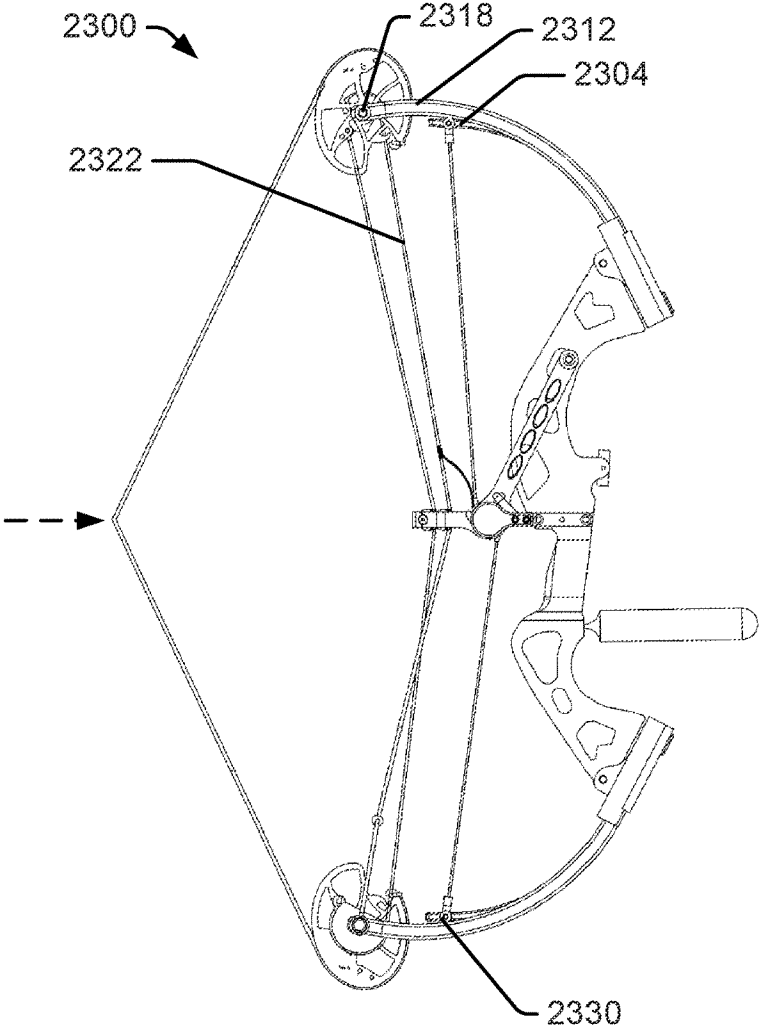

FIGS. 31A-B show the illustrative embodiment of FIG. 23A after the draw string 2320 may have been released applying a force to an arrow (not shown) to propel it. Various embodiments contemplate that the force applied to the arrow was supplied by the release of the energy from both the limbs 2312 and the auxiliary members 2304.

Additionally or alternatively, when an arrow is released, a vibration may be generated by the bow and the bow components. Various embodiments contemplate that the interface between the auxiliary member 2304 and the limbs 2312 may be configured such that vibration in the limbs 2312 is dampened by the auxiliary member 2304 and/or the interface between the member 2304 and the limbs 2312.

Various embodiments contemplate that auxiliary member 2304 may be preloaded with energy when positioned in the at rest position shown in FIG. 23A. This may have an effect of allowing a larger amount of energy stored in it and possibly provide a better power curve during loading as well as propelling an arrow when released. Further, this preloading may also have the capability to augment dampening of the system by applying a force to effectively engage with limbs 2312.

Additionally or alternatively, the coupling at auxiliary member 2304 to the load cables 2326 may be a fixed junction or may provide for an interface with a cam, pulley, or combination thereof.

Figure 32:
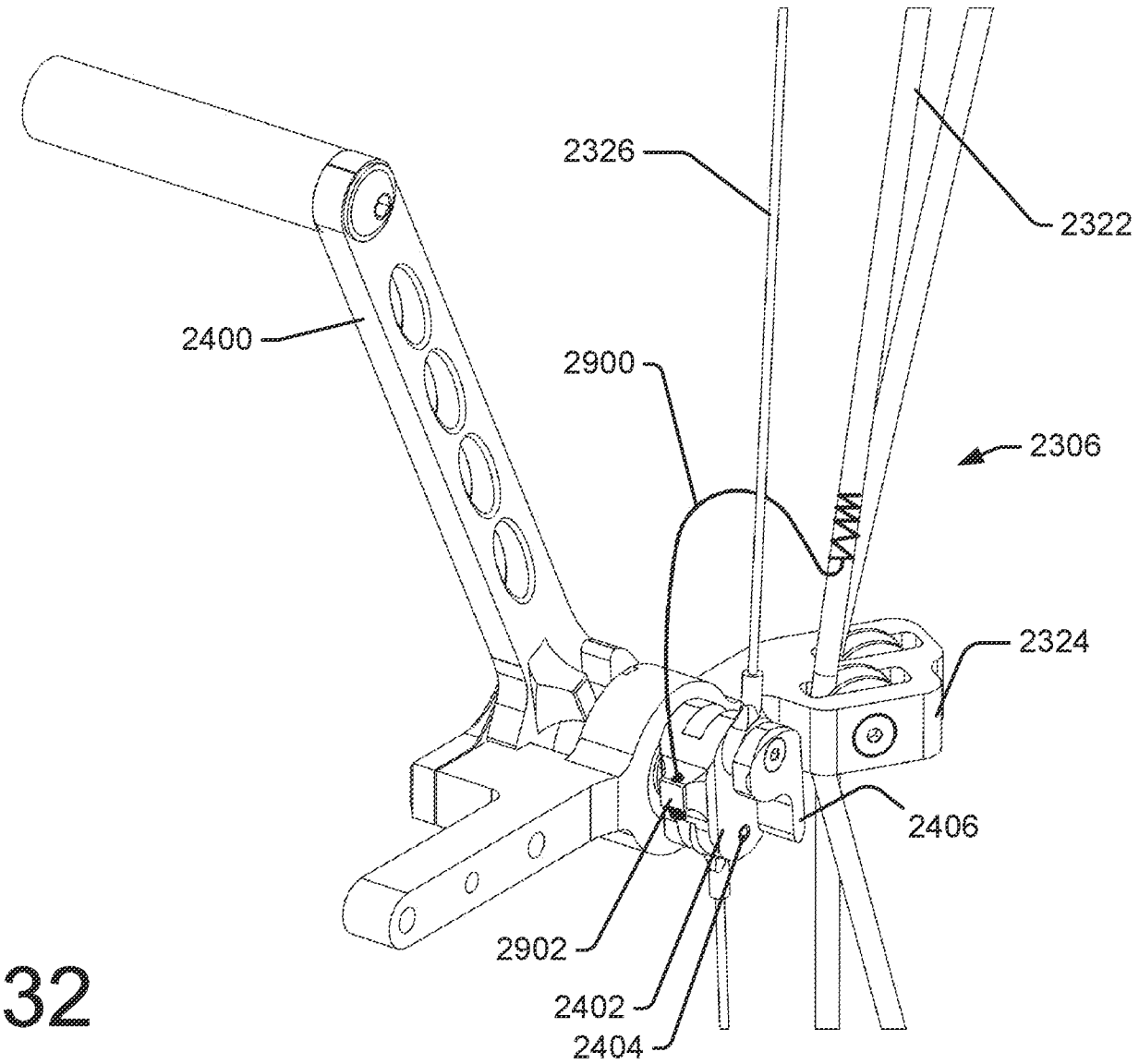
FIG. 32 depicts an illustrative perspective view of the compound bow with a power assist system of FIGS. 23A-C.

FIG. 32 shows a perspective view of the embodiment shown in FIG. 23A. Additionally or alternatively, various embodiments contemplate that the loading mechanism 2306 may be removeably coupled to the bow 2300. For example, loading mechanism 2306 may be coupled to an existing buss cable guide or it may be coupled to the riser 2310. It is also noted that buss cables 2322 may be positioned on the side of the riser 2310 opposite to what is shown in FIG. 32.

Figure 33:
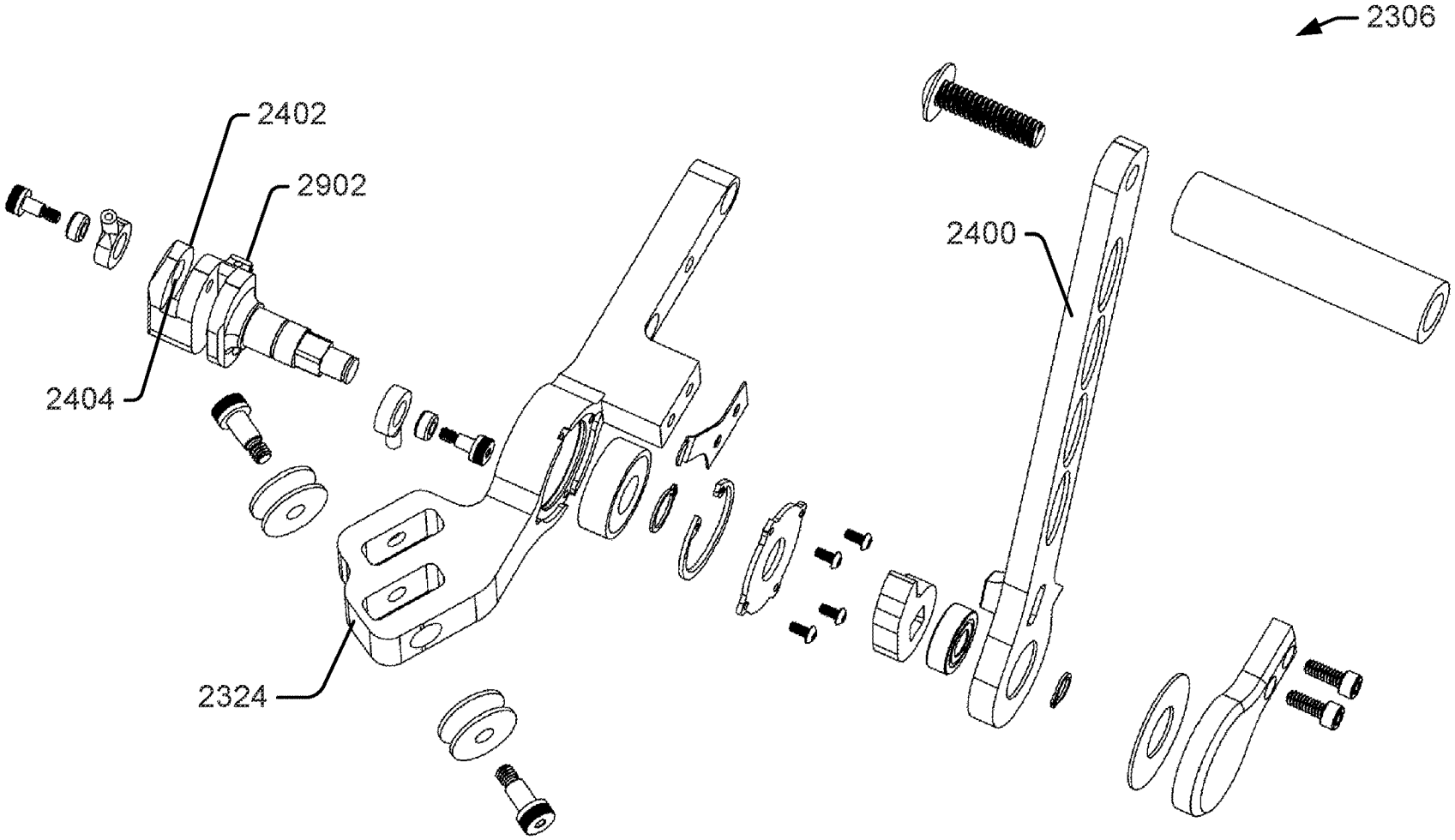
FIG. 33 depicts an exploded view of a portion of an illustrative power assist system.

FIG. 33 shows an exploded perspective view of illustrative loading mechanism 2306.

Illustrative Methods

Figure 34:
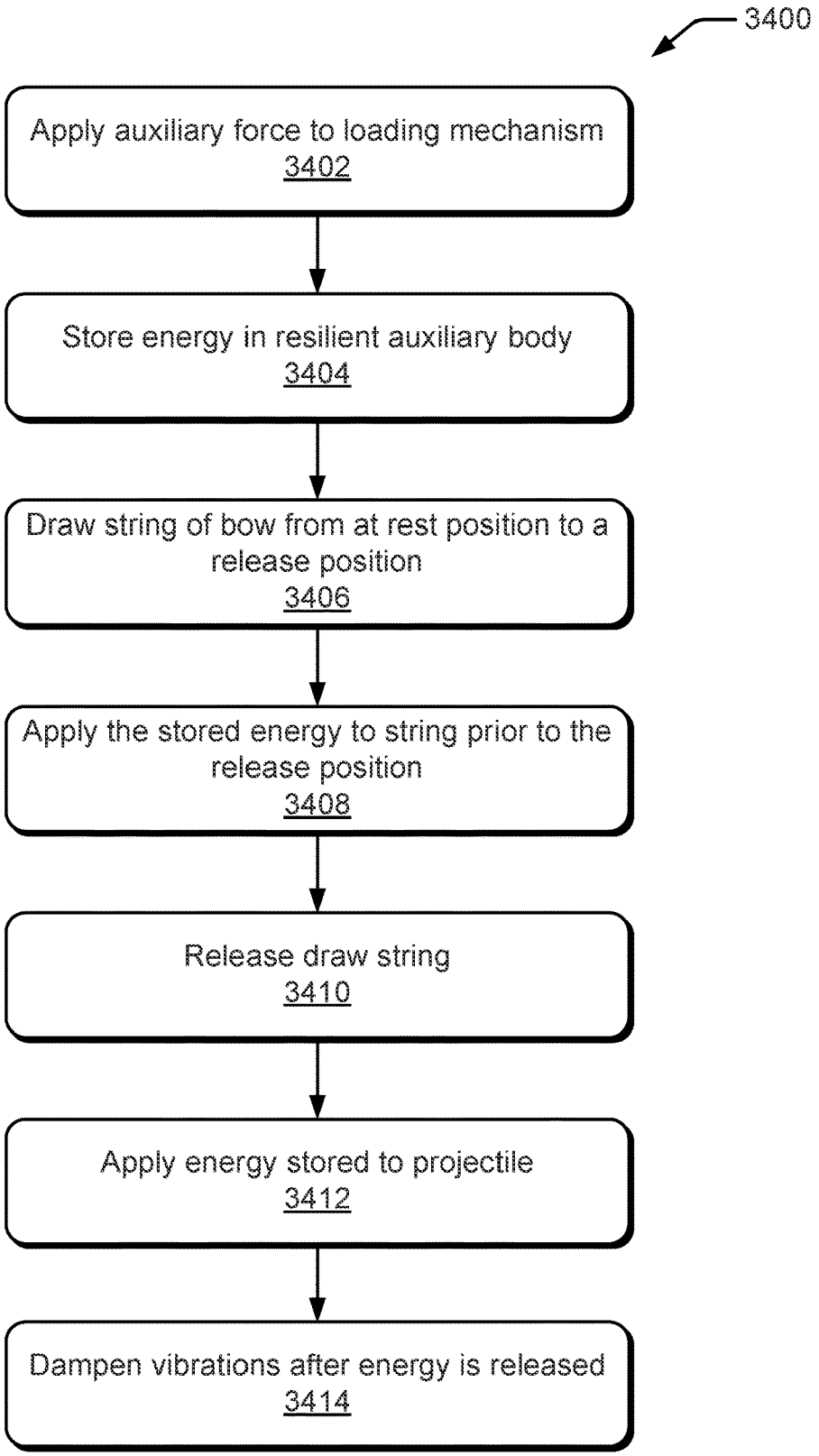
FIG. 34 depicts a flowchart illustrating operation of a compound bow with a power assist system.

FIG. 34 is a flowchart of one illustrative method 3400 of operating a bow with a power assist system as discussed above with respect to the various contemplated embodiments. For ease of understanding, the method 3400 is described in the context of the configuration shown in FIGS. 23A-31B. However, the method 3400 is not limited to performance using such a configuration and may be applicable to other bows and other types of power assist systems.

In this particular implementation, the method 3400 begins at block 3402 in which an auxiliary force is applied to a loading mechanism, for example, loading mechanism 2306. At block 3404, energy is stored in a resilient auxiliary body, for example, auxiliary member 2304.

At block 3406, a draw string of the bow may be drawn from an at rest position towards a release position. It is contemplated that an arrow may be nocked in anticipation of shooting the arrow.

At block 3408, the stored energy from block 3404 is applied to the draw string prior to the draw string reaching the release position. For example, limbs 2312 may be displaced such that the engage auxiliary members 2304 and exert a force sufficient to hold the auxiliary members 2304 in an energized position. Additionally or alternatively, various embodiments contemplate that a locking mechanism may be disengaged prior to the draw string reaching the release position, but after the limbs 2312 engage auxiliary members 2304.

Additionally or alternatively, various embodiments contemplate that the limbs 2312 may begin to engage auxiliary members 2304 as the force on the draw string begins to let off. For example, as the let off would normally reduce the load by a force amount per unit drawn, the engagement of the auxiliary members 2304 would cause a similar amount of force per unit drawn to be added to the draw string. The added amount may be at a higher or lower ratio than the let off would normally provide. Various embodiments contemplate that the let off and the additional force added by the auxiliary members may provide for a smooth transition such that a user may not notice the change or change over.

Additionally or alternatively, a projectile, if loaded may be released and propelled by the stored energy in the limbs 2312 and auxiliary members 2304.

At block 3410, the draw string may be released and the energy stored in both the limbs 2312 and the auxiliary members 2304 may be transferred to a projectile at block 3412.

At block 3414, the auxiliary members may provide dampening to the bow after the energy has been released.

Conclusion

Although embodiments have been described in language specific to structural features and/or methodological acts, it is to be understood that the disclosure and appended claims are not necessarily limited to the specific features or acts described. Rather, the specific features and acts are disclosed as illustrative forms of implementing the embodiments. For example, the methodological acts need not be performed in the order or combinations described herein, and may be performed in any combination of one or more acts.

What is claimed is:

1. An archery bow, comprising: a loading assembly comprising a rotational member, the rotational member comprising a protrusion, the rotational member coupled to a first auxiliary limb via a first cable, wherein the rotational member is configured to engage the first cable upon rotation of the rotational member by contacting the first cable via the protrusion, thereby preventing further rotation of the rotational member in a pre-load lock position, an engagement device disposed at an end of the first auxiliary limb, wherein the first auxiliary limb is configured to transfer energy stored in the first auxiliary limb to a first main limb via the engagement device, wherein the engagement device comprises at least one of a wheel, a roller, and a pad; a loading lever coupled to the rotational member, wherein the loading lever is configured to rotate the rotational member in a first rotational direction to move the first cable in a first direction to pre-load the first auxiliary limb, a second auxiliary limb coupled to the rotational member via a second cable.

2. The archery bow of claim 1, wherein the loading lever is configured to simultaneously move the first cable in the first direction and the second cable in a second direction opposite the first direction to pre-load the second auxiliary limb.

3. The archery bow of claim 2, wherein the loading assembly is coupled to a central riser.

4. The archery bow of claim 3, further comprising a main body including a first main limb and a second main limb, wherein the loading assembly is coupled to the central riser of the main body between the first main limb and the second main limb.

5. The archery bow of claim 4, further comprising a string extending from the first main limb to the second main limb, wherein the loading lever is configured to rotate the rotational member to pre-load the first auxiliary limb and the second auxiliary limb without drawing the string.

6. The archery bow of claim 5, further comprising a cam disposed at an end of the first main limb, a third cable extending between the second main limb and the cam, and a tether having a first end coupled directly to the third cable and a second end coupled directly to the loading assembly, wherein the tether is configured to counter rotate the rotational member from the pre-load lock position to a released unlocked position.

7. A loading assembly for an archery bow, comprising: a rotational member comprising a protrusion, the rotational member coupled to a first auxiliary limb of the archery bow; a first cable coupled to the first auxiliary limb and the rotational member, wherein the rotational member is configured to engage the first cable upon rotation of the rotational member by contacting the first cable with the protrusion, thereby preventing further rotation of the rotational member in a pre-load lock position, a tether having a first end coupled directly to a third cable and a second end coupled directly to the loading assembly to counter rotate the rotational member from the pre-load lock position to a released unlocked position, comprising a loading lever coupled to the rotational member for rotating the rotational member in a first rotational direction to move the first cable in a first direction to pre-load the first auxiliary limb, a second auxiliary limb coupled to the rotational member via a second cable.

8. The loading assembly of claim 7, wherein the loading lever is configured to simultaneously move first cable in the first direction and the second cable in a second direction opposite the first direction to pre-load the second auxiliary limb.

* * * * *